US009902578B2

(12) United States Patent
Wakabayashi et al.

(10) Patent No.: US 9,902,578 B2
(45) Date of Patent: Feb. 27, 2018

(54) SHEET CONTAINING DEVICE, SHEET FEEDER INCORPORATING THE SHEET CONTAINING DEVICE, AND IMAGE FORMING APPARATUS INCORPORATING THE SHEET CONTAINING DEVICE

(71) Applicants: Yu Wakabayashi, Kanagawa (JP); Ryuta Kaneda, Kanagawa (JP); Shohei Shinkawa, Tokyo (JP)

(72) Inventors: Yu Wakabayashi, Kanagawa (JP); Ryuta Kaneda, Kanagawa (JP); Shohei Shinkawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/139,790

(22) Filed: Apr. 27, 2016

(65) Prior Publication Data

US 2016/0334747 A1 Nov. 17, 2016

(30) Foreign Application Priority Data

May 11, 2015 (JP) ..... 2015-096855
Mar. 11, 2016 (JP) ..... 2016-048665

(51) Int. Cl.
*B65H 1/14* (2006.01)
*B65H 1/24* (2006.01)
(Continued)

(52) U.S. Cl.
CPC ..... *B65H 1/14* (2013.01); *B65H 1/04* (2013.01); *B65H 1/24* (2013.01); *B65H 1/26* (2013.01);
(Continued)

(58) Field of Classification Search
CPC ... B65H 1/14; B65H 1/24; B65H 1/26; B65H 1/04; B65H 2405/1142; B65H 2405/1144; B65H 2701/1822
(Continued)

(56) References Cited

U.S. PATENT DOCUMENTS 7,871,072 B2 * 1/2011 Rowe ..... B65H 1/26 271/171
7,997,574 B2 * 8/2011 Sugiyama ..... B65H 1/28 271/9.01
(Continued)

FOREIGN PATENT DOCUMENTS

JP 11-255346 9/1999
JP 2000-191146 7/2000
(Continued)

*Primary Examiner* — Jeremy R Severson
(74) *Attorney, Agent, or Firm* — Harness, Dickey & Pierce, P.L.C.

(57) ABSTRACT

A sheet containing device, which is included in a sheet feeder and an image forming apparatus, includes a first sheet container, a second sheet container disposed adjacent to the first sheet container, a transfer unit to transfer a bundle of sheets contained in the second sheet container to the first sheet container, a pair of side fences including a first side fence and a second side fence to regulate a position of the bundle of sheets in a width direction of the bundle of sheets loaded on the first sheet container, and a pressing unit mounted on the first side fence and pressing the bundle of sheets loaded on the first sheet container against the second side fence.

24 Claims, 16 Drawing Sheets

(51) Int. Cl.
*B65H 1/26* (2006.01)
*B65H 1/04* (2006.01)
*G03G 15/00* (2006.01)

(52) U.S. Cl.
CPC .. *G03G 15/6502* (2013.01); *B65H 2405/1142* (2013.01); *B65H 2701/1822* (2013.01)

(58) Field of Classification Search
USPC ..... 271/9.08
See application file for complete search history.

(56) References Cited

U.S. PATENT DOCUMENTS 8,191,892 B2 * 6/2012 Fuda ..... B65H 1/04 271/171
8,777,209 B2 * 7/2014 Chae ..... B65H 1/266 271/164
8,894,063 B2 * 11/2014 Araaki ..... B65H 1/266 271/145
8,985,571 B2 * 3/2015 Ueda ..... B65H 1/04 271/171
9,145,274 B2 * 9/2015 Sato ..... B65H 1/14
2011/0121506 A1 5/2011 Ishikawa et al.
2011/0204557 A1 8/2011 Ishikawa et al.
2012/0061908 A1 * 3/2012 Ueda ..... B65H 1/08 271/162
2013/0270765 A1 10/2013 Araaki et al.
2016/0257507 A1 * 9/2016 Nakagawa ..... B65H 1/08

FOREIGN PATENT DOCUMENTS

JP 2013-170068 9/2013
JP 2014-047007 3/2014
JP 2014-177336 9/2014
JP 2014-202803 10/2014
JP 2015-000800 1/2015
JP 2015-071496 4/2015

* cited by examiner

SHEET CONTAINING DEVICE, SHEET FEEDER INCORPORATING THE SHEET CONTAINING DEVICE, AND IMAGE FORMING APPARATUS INCORPORATING THE SHEET CONTAINING DEVICE

CROSS-REFERENCE TO RELATED APPLICATIONS

This patent application is based on and claims priority pursuant to 35 U.S.C. § 119(a) to Japanese Patent Application Nos. 2015-096855, filed on May 11, 2015, and 2016-048665, filed on Mar. 11, 2016, in the Japan Patent Office, the entire disclosure of each of which is hereby incorporated by reference herein.

BACKGROUND

Technical Field

This disclosure relates to a sheet containing device, a sheet feeder including the sheet containing device, and an image forming apparatus including the sheet containing device.

Related Art

Various types of electrophotographic image forming apparatus are known to include a sheet conveying device or a sheet feeder to convey a sheet one by one from a sheet containing device that accommodates multiple sheets therein to an image forming apparatus or to an image forming device.

As an example, a sheet containing device that includes a first sheet container and a second sheet container. The first sheet container accommodates multiple sheets therein to be fed to a sheet feeding device. The second sheet container is disposed upstream from the first sheet container in a sheet feeding direction and includes multiple sheets. The sheet containing device further includes a sheet transfer unit. When it is detected that there is no sheet left in the first sheet container, multiple sheets contained in the second sheet container are transferred altogether to the sheet transfer unit. The first sheet container includes a pair of side fences and a moving device. Both fences of the pair of side fences are disposed facing each other with a sheet interposed therebetween in a sheet width direction. The pair of side fences functions as a regulator to regulate a position in the sheet width direction of the sheet. The moving device moves the pair of side fences in the sheet width direction.

In a case in which a bundle of sheets accommodated in the second sheet container is transferred to the first sheet container, a motor of the moving device is driven to move the pair of side fences automatically from a regulating position, where a position of the sheet in the sheet width direction is regulated, to a retreating position. Then, when a sensor detects that the pair of side fences has arrived the retreating position, the sheet transfer unit is driven to transfer the bundle of sheets loaded on the second sheet container to the first sheet container. After the bundle of sheets has been transferred to the first sheet container, the motor of the moving device is driven to move the pair of side fences from the retreating position to the regulating position automatically.

SUMMARY

At least one aspect of this disclosure provides a sheet containing device including a first sheet container, a second sheet container disposed adjacent to the first sheet container, a transfer unit to transfer a bundle of sheets contained in the second sheet container to the first sheet container, a pair of side fences including a first side fence and a second side fence to regulate a position of the bundle of sheets in a width direction of the bundle of sheets loaded on the first sheet container, and a pressing unit mounted on the first side fence and pressing the bundle of sheets loaded on the first sheet container against the second side fence.

Further, at least one aspect of this disclosure provides a sheet feeder including the above-described sheet containing device to contain a sheet, and a sheet feeding unit disposed near the sheet containing device to feed the sheet from the sheet containing device.

Further, at least one aspect of this disclosure provides an image forming apparatus including the above-described sheet containing device to contain a sheet, a sheet feeding unit disposed near the sheet containing device to feed the sheet from the sheet containing device, and an image forming device to form an image on the sheet fed by the sheet feeding unit.

DETAILED DESCRIPTION

Figure 1:
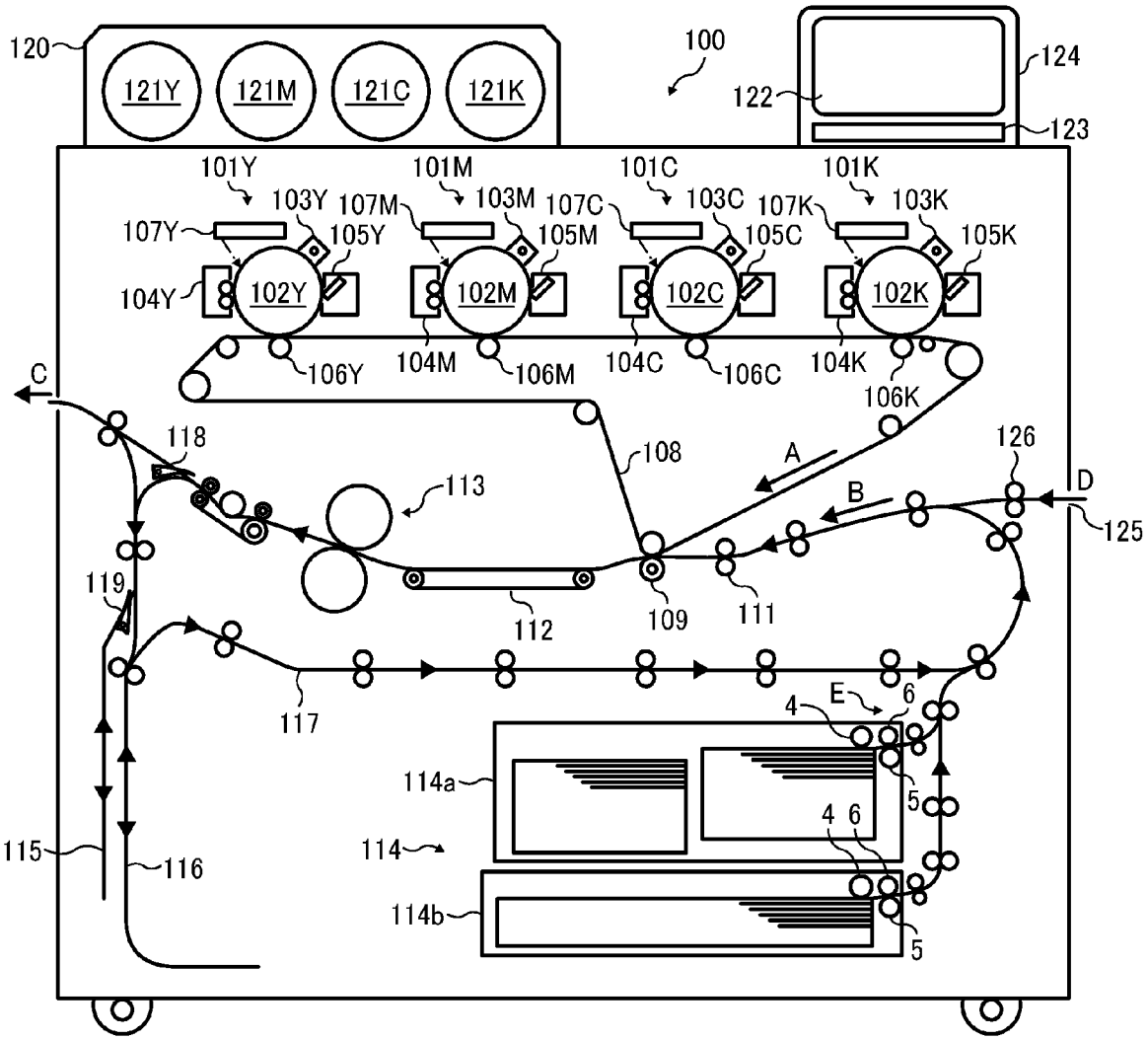
FIG. 1 is a diagram illustrating a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of an entire configuration and functions of an image forming apparatus 100 according to an embodiment of this disclosure.

FIG. 1 is a diagram illustrating a schematic configuration of the image forming apparatus according to an embodiment of this disclosure.

It is to be noted that identical parts are given identical reference numerals and redundant descriptions are summarized or omitted accordingly.

The image forming apparatus 100 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

The image forming apparatus 100 has printing and copying functions for forming a full color toner image with four color toners such as yellow (Y), cyan (C), magenta (M), and black (K). As illustrated in FIG. 1, the image forming apparatus 100 includes four image forming units 101Y, 101M, 101C, and 101K. The image forming units 101Y, 101M, 101C, and 101K that form respective single color images are aligned at an upper part of an apparatus body of the image forming apparatus 100. The image forming units 101Y, 101M, 101C, and 101K have a substantially identical configuration and functions to each other. Therefore, following details of the image forming units 101Y, 101M, 101C, and 101K are described with a single image forming unit that corresponds to each of the image forming units 101Y, 101M, 101C, and 101K, without the suffixes Y, M, C, and K. The image forming unit 101 (i.e., the image forming units 101Y, 101M, 101C, and 101K) includes a photoconductor drum 102 (i.e., photoconductor drums 102Y, 102M, 102C, and 102K), a charger 103 (i.e., chargers 103Y, 103M, 103C, and 103K), and a cleaning device 105 (i.e., cleaning devices 105Y, 105M, 105C, and 105K). The charger 103, the developing device 104, and the cleaning device 105 are disposed around the photoconductor drum 102. Further, an optical writing device 107 is disposed above the photoconductor drum 102.

An intermediate transfer belt 108 is disposed below the image forming units 101Y, 101M, 101C, and 101K. The intermediate transfer belt 108 is wound around multiple support rollers. As one of the multiple support rollers is driven by a drive unit, the intermediate transfer belt 108 is rotated in a direction indicated by arrow A in FIG. 1. A transfer roller 106 (i.e., transfer rollers 106Y, 106M, 106C, and 106K) that functions as a primary transfer unit is disposed facing the photoconductor drum 102 of the image forming unit 101 with the intermediate transfer belt 108 interposed therebetween. When the transfer roller 106 and the photoconductor drum 102 contact with the intermediate transfer belt 108 interposed therebetween, a primary transfer portion is formed to primarily transfer the toner image onto the photoconductor drum 102.

In the image forming unit 101, the photoconductor drum 102 is rotated in a counterclockwise direction in FIG. 1. Then, the charger 103 uniformly charges a surface of the photoconductor drum 102 to a predetermined polarity. Then, an optically modulated laser light beam is emitted from the optical writing device 107, so that an electrostatic latent image is formed on the charged surface of the photoconductor drum 102. The electrostatic latent image is developed with toner applied by the developing device 104 into a visible toner image. The visible toner images of respective single colors formed by the image forming units 101Y, 101M, 101C, and 101K are sequentially transferred in layers onto a surface of the intermediate transfer belt 108.

By contrast, a sheet feeding device 114 is disposed below the apparatus body of the image forming apparatus 100. The sheet feeding device 114 includes a tandem sheet tray 114*a* and a sheet tray 114*b* and feeds out a sheet. The fed sheet is conveyed to a pair of registration rollers 111 in a direction indicated by arrow B in FIG. 1.

The sheet contacted and temporarily stopped at the pair of registration rollers 111 is fed out from the pair of registration rollers 111 in synchronization with movement of the toner image formed on the surface of the intermediate transfer belt 108. Then, the sheet is conveyed to a secondary transfer portion where a secondary transfer roller 109 contacts the intermediate transfer belt 108. A voltage having an opposite polarity to a toner charge polarity is applied to the secondary transfer roller 109. By so doing, the overlaid toner image (the full color toner image) formed on the surface of the intermediate transfer belt 108 is transferred onto the sheet. After the toner image has been transferred thereto, the sheet is conveyed by a sheet conveying belt 112 to a fixing device 113. In the fixing device 113, the toner image is fixed to the sheet by application of heat and pressure. After the toner image is fixed thereto, the sheet is ejected out of the apparatus body of the image forming apparatus 100 as indicated by arrow C in FIG. 1 onto a sheet ejection tray.

It is to be noted that, when the sheet is ejected with the back of the sheet facing up in the single-side printing (a face down ejection), the sides of the sheet are reversed by ejecting the sheet outside the apparatus body of the image forming apparatus 100 as indicated by arrow C in FIG. 1 via a sheet reverse portion 115. Further, in the duplex printing, the sheet after the toner image has been fixed thereto is conveyed via a duplex reverse portion 116 from a reentry path 117 to the pair of registration rollers 111 again. By so doing, a toner image formed on the surface of the intermediate transfer belt 108 is transferred onto the back of the sheet. After the toner image has been transferred onto the sheet, the toner image is fixed to the sheet in the fixing device 113. Then, similar to the single-side printing, the sheet is ejected out in the direction C in FIG. 1 directly from the fixing device 115 or via the sheet reverse portion 115. In addition, switching claws 118 and 119 are disposed appropriately to switch a sheet conveying direction.

In a case of a monochrome printing, the image forming apparatus 100 according to the present embodiment uses the image forming unit 101K to form a monochrome toner image and transfers the monochrome toner image onto a sheet via the intermediate transfer belt 108. A sheet having a monochrome toner image thereon is handled along the same process as a sheet having a full color toner image after the toner image is fixed to the sheet.

It is to be noted that the image forming apparatus 100 further includes a toner bottle set 120 on an upper face of the apparatus body. The toner bottle set 120 sets respective color toner bottles 121 (i.e., toner bottles 121Y, 121M, 121C, and 121K) that contains toner to be supplied to the developing device 104 of the image forming unit 101. Further, the image forming apparatus 100 further includes an operation unit 124 that includes a display 122 and a control panel 123.

In addition, the image forming apparatus 100 further includes a bypass tray opening 125 and a pair of bypass rollers 126. A sheet loaded on a bypass tray is guided into the apparatus body of the image forming apparatus 100 through the bypass tray opening 125 in a direction indicated by arrow D and fed by the pair of bypass rollers 126 toward the pair of registration rollers 111.

Figure 2:
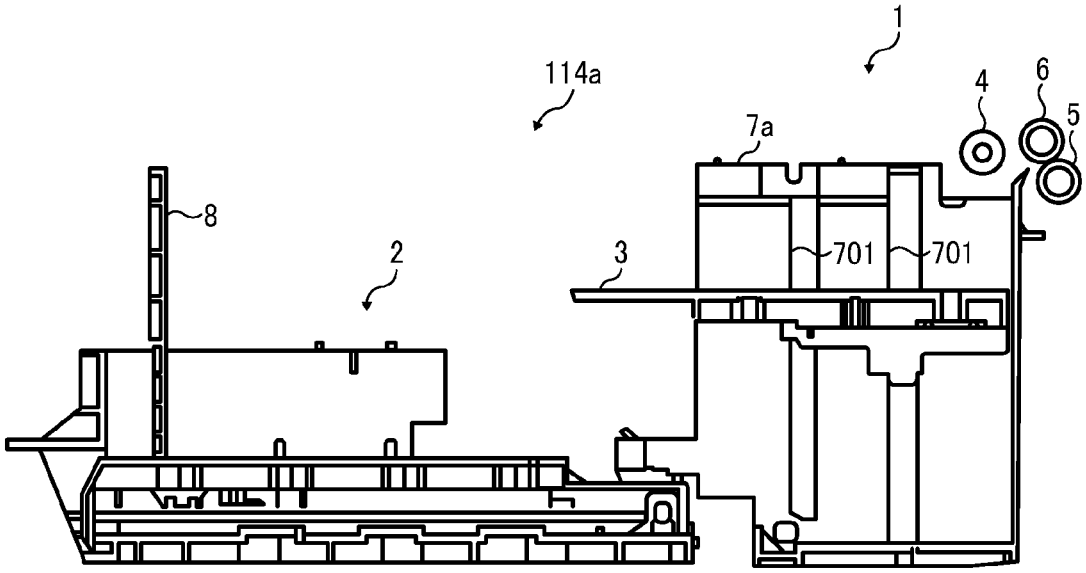
FIG. 2 is a cross sectional view illustrating a tandem sheet tray.

FIG. 2 is a cross sectional view illustrating the tandem sheet tray 114*a*.

As illustrated in FIG. 2, the tandem sheet tray 114*a* includes a sheet feed tray 1 that functions as a first sheet container and a sheet supply tray 2 that functions as a second sheet container.

The sheet feed tray 1 of the tandem sheet tray 114*a* includes a bottom plate 3 that can be lifted and lowered. The sheet feed tray 1 further includes a sheet pickup roller 4 that functions as a sheet feeding unit, a sheet reverse roller 5, and a sheet feed roller 6. The sheet pickup roller 4 closely contacts an uppermost sheet placed on top of the bundle of sheets loaded on the bottom plate 3, and feeds the sheet toward a sheet separation nip region where the sheet feed roller 6 and the sheet reverse roller 5 contact each other. The sheet fed toward the sheet separation nip region is separated from the sheet feed roller 6 and the sheet reverse roller 5. Then, the uppermost sheet is conveyed toward the pair of registration rollers 111. Further, the sheet feed tray 1 is mounted with a pair of side fences 7*a* and 7*b* to regulate a position in a sheet width position of the bundle of sheets on the bottom plate 3.

It is to be noted that the sheet tray 114*b* includes the sheet pickup roller 4 that functions as a sheet feeding unit, the sheet reverse roller 5, and the sheet feed roller 6. Since the sheet pickup roller 4, the sheet reverse roller 5, and the sheet feed roller 6 have the structure and functions identical to the sheet pickup roller 4, the sheet reverse roller 5, and the sheet feed roller 6 included in the tandem sheet tray 114*a*. Therefore, details of the sheet pickup roller 4, the sheet reverse roller 5, and the sheet feed roller 6 included in the sheet tray 114*b* are omitted here.

The sheet supply tray 2 that functions as a second sheet container is disposed substantially horizontally along with the sheet feed tray 1. The sheet supply tray 2 is also removably inserted to the apparatus body of the image forming apparatus 100 in a direction substantially perpendicular to the sheet conveying direction. The sheet supply tray 2 includes a sheet transfer fence 8 to transfer a bundle of sheets loaded on the sheet supply tray 2 altogether to the sheet feed tray 1.

Figure 3:
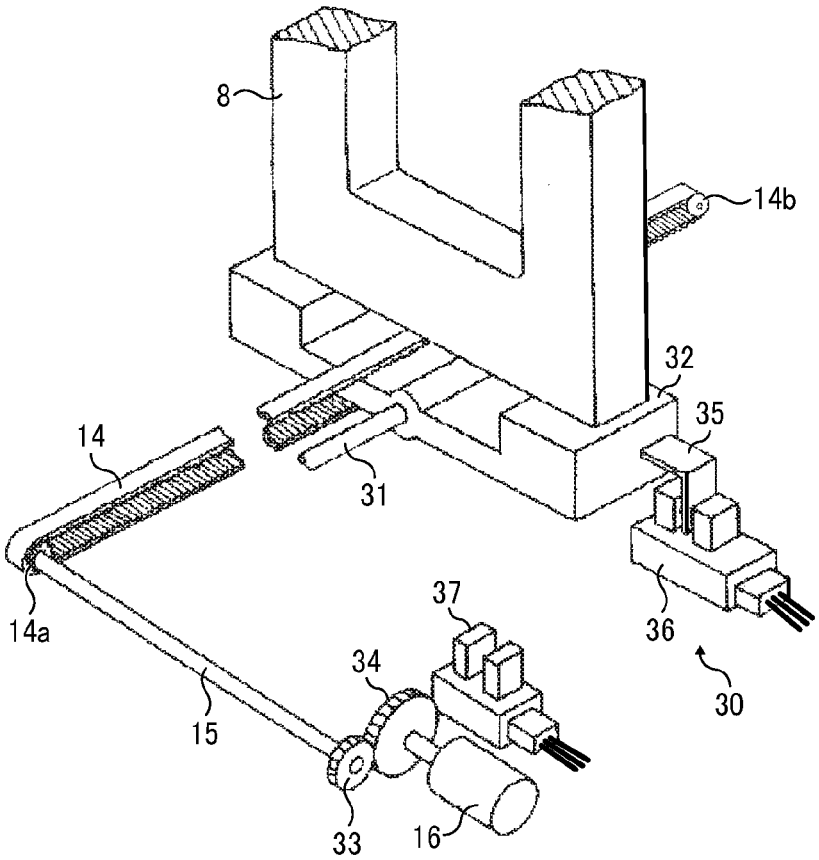
FIG. 3 is a schematic perspective view illustrating an example of a transfer drive.

FIG. 3 is a schematic perspective view illustrating an example of a transfer drive 30 that reciprocates the sheet transfer fence 8.

The transfer drive 30 includes a support table 32 to which the sheet transfer fence 8 is secured. The support table 32 is reciprocally held by a guide shaft 31 that is secured to the sheet supply tray 2. The support table 32 is secured to a timing belt 14 that is wound around a pair of pulleys 14*a* and 14*b*. The pulley 14*a* of the pair of pulleys is secured to one end of a sheet bundle transfer shaft 15. A transfer output gear 33 is secured to an opposed end of the sheet bundle transfer shaft 15. The transfer output gear 33 meshes with a transfer motor gear 34 of a transfer motor 16. In addition, a feeler 35 is mounted on the support table 32 at a side face of the transfer motor 16.

The tandem sheet tray 114*a* further includes a home position detecting sensor 36 and a fence arrival detecting sensor 37. The home position detecting sensor 36 includes a transmission optical sensor to detect that the sheet transfer fence 8 is located at a home position. The fence arrival detecting sensor 37 includes a transmission optical sensor to detect that the sheet transfer fence 8 has arrived at a transfer complete position. As the sheet transfer fence 8 comes to the home position, the feeler 35 mounted on the support table 32 blocks light emitted by a light emitting element of the home position detecting sensor 36, and therefore a light receiving element of the home position detecting sensor 36 cannot detect the light from the light emitting element. According to this action, the home position detecting sensor 36 detects that the sheet transfer fence 8 is located at the home position. Similarly, as the sheet transfer fence 8 has arrived at the transfer complete position, the feeler 35 blocks light emitted by a light emitting element of the fence arrival detecting sensor 37, and therefore a light receiving element of the fence arrival detecting sensor 37 cannot detect the light from the light emitting element. According to this action, the fence arrival detecting sensor 37 detects that the sheet transfer fence 8 has arrived at the transfer complete position.

It is to be noted that the transfer drive 30 is not limited to the above-described configuration. For example, a transfer drive having the following configuration is applicable to this disclosure. Specifically, the transfer drive can include a rack and pinion mechanism having a rack gear that is mounted on the support table 32 and a pinion gear that that is mounted on the sheet bundle transfer shaft 15 and meshes with the rack gear. The sheet bundle transfer shaft is reciprocally moved by the rack and pinion mechanism. Alternatively, the transfer drive can have a configuration in which a support table is secured to a wire, so that the sheet transfer fence 8 is reciprocally moved by taking and feeding the wire.

Figure 4:
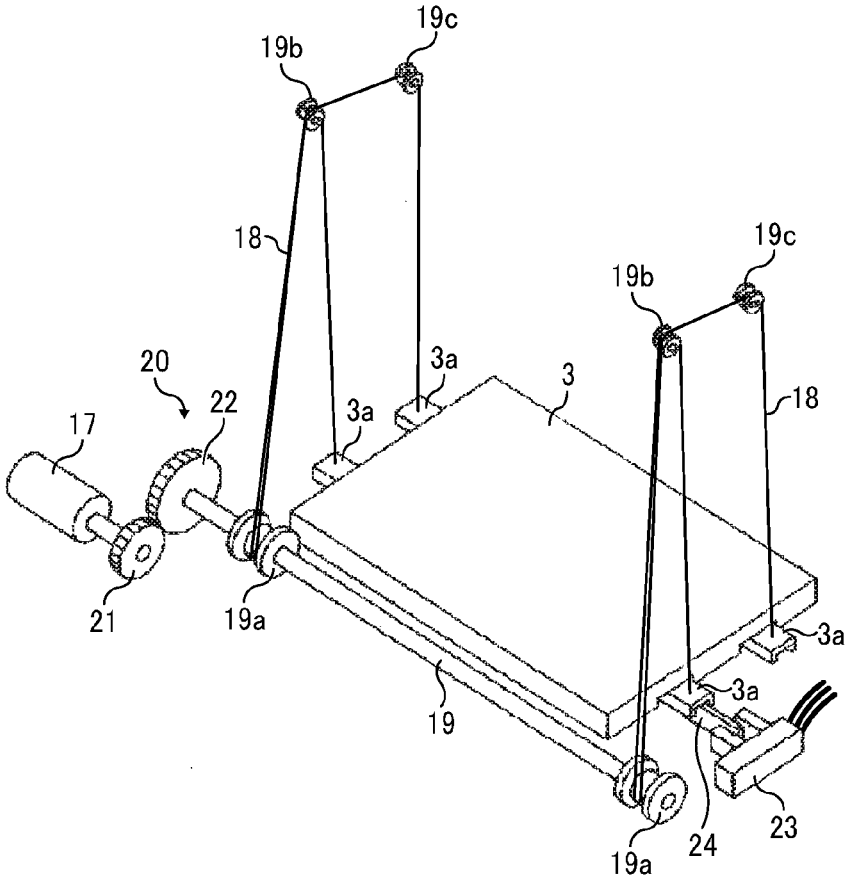
FIG. 4 is a schematic perspective view illustrating an example of a lift drive.

FIG. 4 is a schematic perspective view illustrating an example of a lift drive 20 that ascends and descends the bottom plate 3.

Each two supports 3*a* are disposed projecting in a sheet width direction from both ends of the bottom plate 3 in the sheet width direction. The supports 3*a* go through respective guide openings 701. Each two guide openings 701 extend in a vertical direction and are provided to each of the pair of side fences 7*a* and 7*b*. (See FIG. 2.) One end of the wire 18 is secured to each support 3*a*. The wire 18 is wound around pulleys 19*b* and 19*c* that are disposed above the supports 3*a*. An opposed end of the wire 18 is fixed to a drive pulley 19*a* that is secured to an elevating shaft 19. A lift output gear 22 is fixed to one end of the elevating shaft 19. A lift motor gear 21 of the lift motor 17 is meshed with the lift output gear 22.

Further, the sheet feed tray 1 includes a lowest position detecting sensor 23 that includes a transmission optical sensor to detect the lowest position of the bottom plate 3. When the bottom plate 3 is located at the lowest position, a feeler 24 that is mounted on the bottom plate 3 blocks light emitted from a light emitting element of the lowest position detecting sensor 23. Consequently, a light receiving element of the lowest position detecting sensor 23 does not detect light. As a result, it is detected that the bottom plate 3 is located at the lowest position.

It is to be noted that the lift drive 20 is not limited to the above-described configuration. For example, a lift drive that includes a belt can be also applied to this disclosure. Alternatively, for example, the bottom plate 3 is fixed to a belt extending in a vertical direction. By rotating the belt, the bottom plate 3 can be moved vertically. As another alternative, a lift drive that includes a rack and pinion mechanism can also be applied to this disclosure. In the lift drive, a rack gear that extends in a vertical direction is mounted on the bottom plate 3 and a pinion gear that meshes with the rack gear is mounted on an elevating shaft. By so doing, the bottom plate 3 can be moved vertically.

Figure 5:
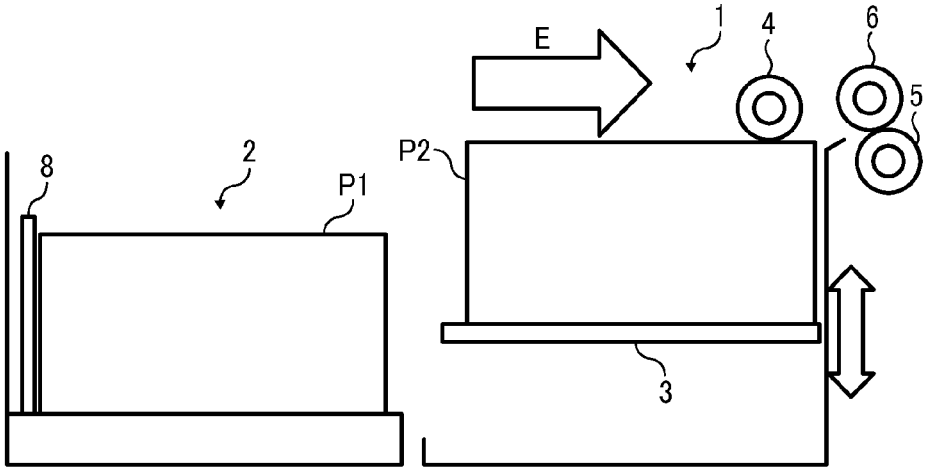
FIG. 5 is a diagram illustrating a sheet feeding state of the tandem sheet tray.

FIG. 5 is a diagram illustrating a sheet feeding state of the tandem sheet tray 114*a*.

As illustrated in FIG. 5, the sheet feed tray 1 accommodates a sheet bundle P2 and the sheet supply tray 2 accommodates a sheet bundle P1. In the present embodiment, the sheet feed tray 1 and the sheet supply tray 2 can contain approximately 500 sheets of various types including A4-size, respectively. It is to be noted that, if the tandem sheet tray 114*a* has a larger capacity, the sheet feed tray 1 and the sheet supply tray 2 can accommodate approximately 1250 sheets, respectively. In the above-described sheet feeding state, the sheet transfer fence 8 is located at a home position.

As the drive pulley 19*a* is rotated by a lift motor 17 illustrated in FIG. 4, the wire 18 is taken up. Then, the bottom plate 3 is lifted up by the wire 18, so that an uppermost sheet of the sheet bundle P2 loaded on the bottom plate 3 contacts the sheet pickup roller 4. By driving the sheet pickup roller 4, the uppermost sheet of the sheet bundle P2 is fed in a direction indicated by arrow E in FIG. 5. Then, the sheet feed roller 6 and the sheet reverse roller 5 separate the uppermost sheet from the sheet bundle P2, so that the uppermost sheet is conveyed toward the pair of registration rollers 111.

When the sheet runs out from the bottom plate 3, the lift motor 17 is reversely driven. Then, the wire 18 is fed from the drive pulley 19*a* along with the aid of gravity of the bottom plate 3 so as to lower the bottom plate 3 to the lowest position. When the bottom plate 3 reaches the lowest position, the feeler 24 mounted on the bottom plate 3 blocks the light emitted by the light emitting element of the lowest position detecting sensor 23. Accordingly, it is detected that the lowest position detecting sensor 23 has detected that the bottom plate 3 has reached the lowest position. After the lowest position detecting sensor 23 has detected that the bottom plate 3 has reached the lowest position, the lift motor 17 is stopped. Further, the transfer motor 16 illustrated in FIG. 3 is rotated regularly. Consequently, the sheet transfer fence 8 that is located at the home position together with the support table 32 moves toward the sheet feed tray 1, so that the sheet transfer fence 8 shifts the sheet bundle P1 loaded on the sheet supply tray 2 to the sheet feed tray 1.

When the sheet bundle P1 is transferred to the sheet feed tray 1 and the sheet transfer fence 8 has arrived a transfer complete position, the feeler 35 of the support table 32 blocks light emitted from the light emitting element. Then, the fence arrival detecting sensor 37 detects that the sheet transfer fence 8 has arrived the transfer complete position. After the fence arrival detecting sensor 37 has detected that the sheet transfer fence 8 has reached the transfer complete position, the transfer motor 16 is reversely driven. Then, the sheet transfer fence 8 retreats together with the support table 32 toward the home position. When the sheet transfer fence 8 reaches the home position, the feeler 35 of the support table 32 blocks light emitted from the light emitting element of the home position detecting sensor 36. Then, the home position detecting sensor 36 detects that the sheet transfer fence 8 has arrived the home position. After the home position detecting sensor 36 has detected that the sheet transfer fence 8 has reached the home position, the transfer motor 16 is stopped.

When no sheets are left on the sheet feed tray 1, the side fences 7*a* and 7*b* transfers a bundle of sheets loaded on the sheet supply tray 2 to the sheet feed tray 1 automatically. Therefore, it is difficult to adjust the side fences 7*a* and 7*b* manually before the bundle of sheets is transferred to the sheet feed tray 1. In such a case, a comparative sheet containing device causes a motor to move a pair of side fences automatically or a pair of side fences to be fixed to a predetermined position.

A bundle of sheets set in the sheet supply tray 2 may be different in width from another bundle of sheets due to cutting position error at sheet production. In a case in which a motor is driven to move the pair of side fences automatically, when the bundle of sheets in the sheet supply tray 2 is transferred to the sheet feed tray 1, the side fences can be retreated to a retreating position. Therefore, even if the width of the bundle of sheets is different from another bundle of sheets, the bundle of sheets can be transferred to the sheet feed tray 1 without being caught by the side fences. However, in this case, a moving mechanism to move the motor and the pair of side fences is provided, and therefore it is likely that an increase in cost of an image forming apparatus due to an increase in the number of parts and an increase in size of the image forming apparatus.

For these reasons, the present embodiment provides a pair of side fences secured at a predetermined position. Accordingly, when compared to a configuration in which a motor is driven to move the pair of side fences, the configuration of the present embodiment can reduce the number of parts, and therefore can reduce the cost and size of the image forming apparatus 100. However, if the side fences 7*a* and 7*b* are secured to respective positions corresponding to a predetermined width of sheet, when the width of the sheet is greater than the predetermined width, it is likely that the bundle of sheets is caught by the side fence 7*a* or the side fence 7*b* to cause the transfer failure of the sheet bundle. Accordingly, a distance between the side fence 7*a* and the side fence 7*b* is longer than the predetermined width. However, in this case, if the width of a set sheet bundle is smaller than the predetermined width, the pair of side fences 7*a* and 7*b* cannot regulate the sheet bundle within the sheet width direction, and therefore the position in the width direction of the sheet to be transferred varies. As a result, the image forming position to the sheet also varies.

In the present embodiment, a pressing member is provided to the side fence 7*a* to press the bundle of sheets loaded on the sheet feed tray 1 against the side fence 7*b* so as to regulate the bundle of sheets in the width direction.

Figure 6:
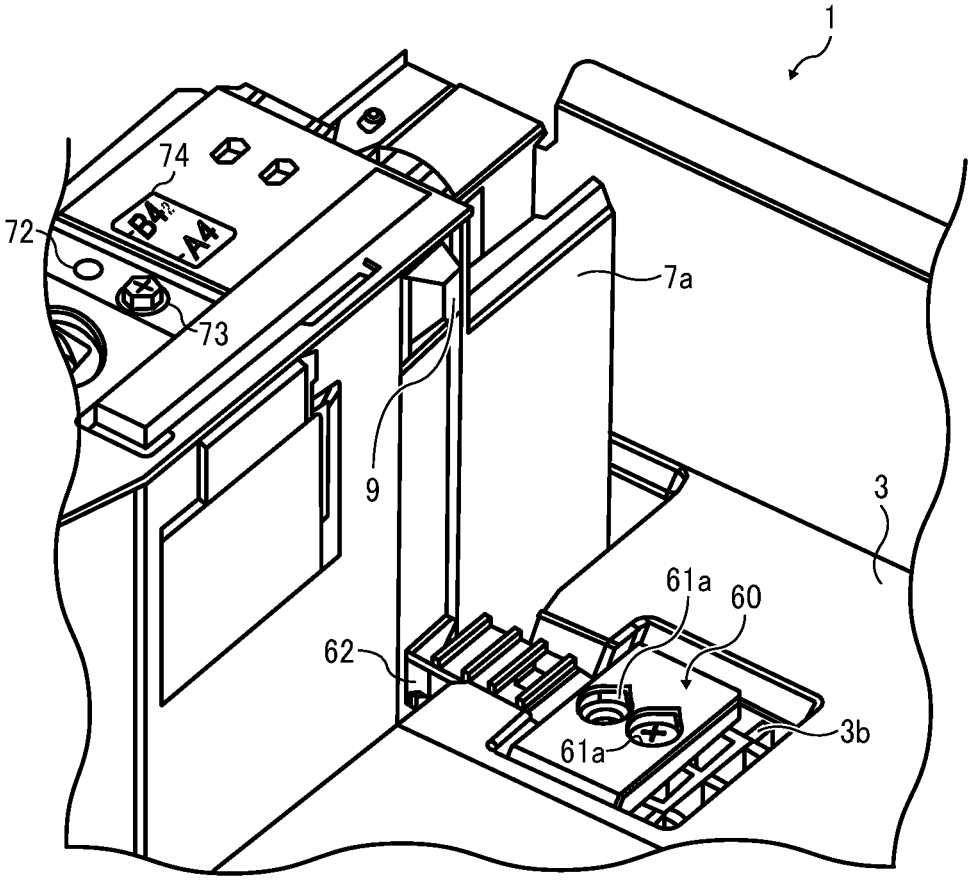
FIG. 6 is a perspective view illustrating an area near a pressing side fence.

FIG. 6 is a perspective view illustrating an area near the side fence 7*a* (hereinafter, the "pressing side fence 7*a*") provided with a pressing member 9.

As illustrated in FIG. 6, the pressing member 9 is disposed above the pressing side fence 7*a* and, as described below, is located above a sheet full position in the sheet supply tray 2.

Further, the bottom plate 3 includes a pressure releasing mechanism 60 that releases the pressure of the pressing member 9 to the sheet when the number of sheets loaded on the bottom plate 3 is smaller than a predetermined value or approaches zero sheet to be a sheet empty state. The pressure releasing mechanism 60 is attached to a pressure releasing mechanism attaching portion 3*b* that is recessed from the upper face of the bottom plate 3. The pressure releasing mechanism 60 is attached to the bottom plate 3 to be located below the upper face of the bottom plate 3. By attaching the pressure releasing mechanism 60 below the upper face of the bottom plate 3, the sheet bundle is not caught by the pressure releasing mechanism 60 when the sheet bundle is transferred to the sheet feed tray 1. Further, a downstream end face in the sheet conveying direction of the pressure releasing mechanism attaching portion 3*b* is a tapered face with the upper part being located on a downstream side in the sheet conveying direction. This configuration can prevent the sheet from being caught by the pressure releasing mechanism attaching portion 3*b* when the sheet bundle is transferred to the sheet feed tray 1.

The pressing side fence 7*a* is movable within a predetermined range in the width direction of the sheet, so that the pressing side fence 7*a* can change the position in the sheet width direction according to the size of the sheet to be contained. Specifically, multiple fixing openings 72 corresponding to respective sheet sizes are formed on the upper face in the sheet width direction of the pressing side fence 7*a* for securing. In addition, a label 74 that indicates respective sheet sizes corresponding to the respective fixing openings 72 is attached to the upper face of the pressing side fence 7*a*. When changing the position in the width direction of the pressing side fence 7*a*, a screw 73 that fixes the pressing side fence 7*a* is removed. Then, the pressing side fence 7*a* is slid in the sheet width direction so as to match the fixing opening 72 corresponding to a sheet size to be accommodated with a screw hole formed on the sheet feed tray 1. Then, the screw 73 is inserted into the fixing opening 72 corresponding to the size of a sheet to be accommodated and is secured to the screw hole. Consequently, the position in the sheet width direction of the pressing side fence 7*a* can be fixed to a position corresponding to the size of the sheet to be accommodated.

Figure 7A:
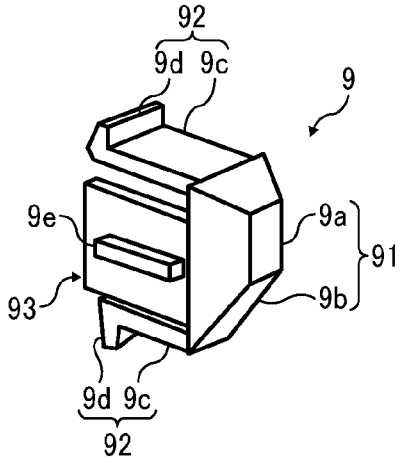
FIG. 7A is a perspective view illustrating a pressing member.
Figure 7B:
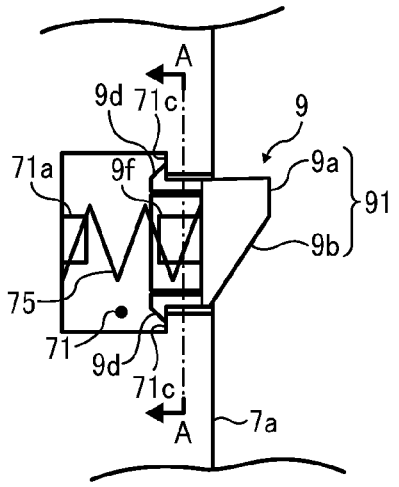
FIG. 7B is a cross sectional view illustrating an area near a pressing member holding portion.
Figure 7C:
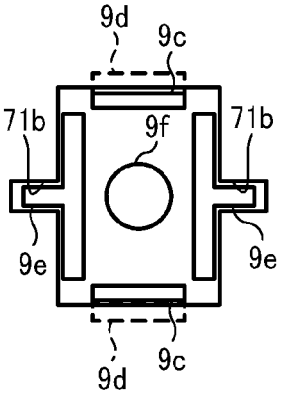
FIG. 7C is a cross sectional view illustrating the pressing member holding portion, along a line A-A of FIG. 7B.

FIG. 7A is a perspective view illustrating the pressing member 9. FIG. 7B is a cross sectional view illustrating an area near a pressing member holding portion of the pressing side fence 7*a*. FIG. 7C is a cross sectional view illustrating the pressing member holding portion, along a line A-A of FIG. 7B.

As illustrated in FIG. 7A, the pressing member 9 includes a pressing portion 91 that functions as a projecting portion, a snap fit 92, and a guide target portion 93.

The pressing portion 91 projects from the pressing side fence 7*a*, as illustrated in FIG. 7B. The pressing portion 91 presses the sheet loaded on the bottom plate 3. The pressing portion 91 includes a pressing face 9*a* and a sloped face 9*b*. The pressing face 9*a* is disposed vertical to the sheet width direction. The sloped face 9*b* extends from the lower end of the pressing face 9*a* and approaches to the pressing side fence 7*a* as advances downwards. In other words, a distance between the sloped face 9*b* and the pressing side fence 7*a* increases upwardly.

The snap fit 92 is a portion to attach the pressing member 9 to the pressing side fence 7*a* to be movable in the sheet width direction. The snap fit 92 is provided to the upper end and lower end of the pressing member 9. The snap fit 92 is elastically bendable in a vertical direction and includes a planar portion 9*c* and a claw 9*d*. The planar portion 9*c* extends from the pressing portion 91 to the pressing side fence 7*a*. The claw 9*d* is mounted on a leading edge of the planar portion 9*c*.

The guide target portion 93 is a portion where the pressing member 9 is guided to be preferably slid in the sheet width direction to the pressing side fence 7*a*. The guide target portion 93 is provided to both a downstream side end and an upstream side end in the sheet conveying direction of the pressing member 9. Each guide target portion 93 includes a guide projection 9*e* that extends from the pressing portion 91 toward the pressing side fence 7*a*.

The pressing side fence 7*a* is provided with a pressing member holding opening 71. The pressing member holding opening 71 is a substantially rectangular opening to hold the pressing side fence 7*a* slidably in the sheet width direction. As illustrated in FIG. 7B, a retaining portion 7*c* is formed projecting toward an inner side at an upper end and a lower end of the opening of the pressing member holding opening 71. As illustrated in FIG. 7C, a guide groove 71*b* is formed in an upstream end face and downstream end face of the pressing member holding opening 71 in the sheet conveying direction. The guide groove 71*b* functions as a guide to guide the guide projection 9*e* of the pressing member 9.

As illustrated in FIG. 7B, a pressure spring holding projection 71*a* is formed on a bottom face of the pressing member holding opening 71. The pressure spring holding projection 71*a* is fitted to one end of a pressure spring 75. Further, a pressing spring holding projection 9*f* is formed at a center on a surface of the pressing portion 91 of the pressing member 9 close to the pressing side fence 7*a*. A pressing spring holding projection 9*f* is fitted to an opposed end of the pressure spring 75.

The pressing member 9 is attached to the pressing side fence 7*a* along with the following processes. Specifically, the pressure spring holding projection 71*a* of the pressing member holding opening 71 is fitted to one end of the pressure spring 75. The pressing spring holding projection 9*f* of the pressing member 9 is fitted to the opposed end of the pressure spring 75. Then, as the pressure spring 75 is pressed, while the guide projection 9*e* is inserted into the guide groove 71*b*, the pressing member 9 is pressed to the pressing side fence 7*a*. At that time, the claw 9*d* of the snap fit 92 is caught by the retaining portion 71*c*. As the pressure spring 75 is further pressed, the planar portion 9*c* of the snap fit 92 is elastically bent to an inner side, and eventually the claw 9*d* rides over the retaining portion 71*c*. As the claw 9*d* rides over the retaining portion 71*c*, elastic deformation of the planar portion 9*c* is released. When the elastic deformation of the planar portion 9*c* is released, the claw 9*d* comes to face the retaining portion 71*c*. Accordingly, even if the pressing member 9 is biased by the pressing spring 75 toward a direction to leave from the pressing side fence 7*a*, the claw 9*d* contacts against the retaining portion 71*c*. For this reason, the pressing member 9 is held by the pressing member holding opening 71 of the pressing side fence 7*a* without being detached.

Figure 8:
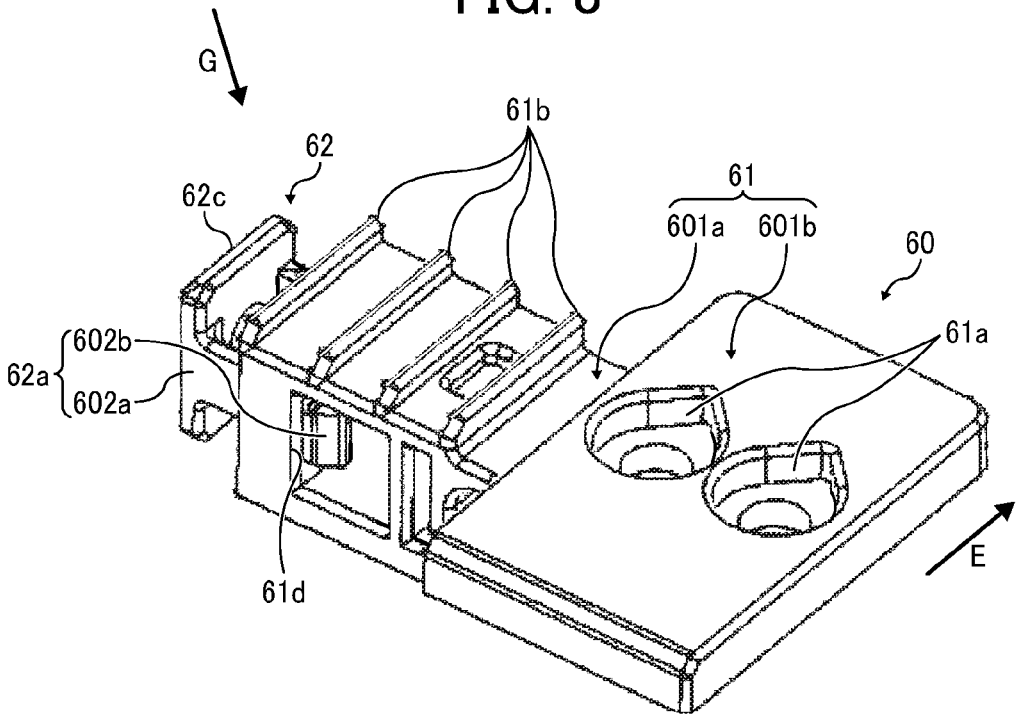
FIG. 8 is a perspective view illustrating a pressure releasing mechanism.
Figure 9:
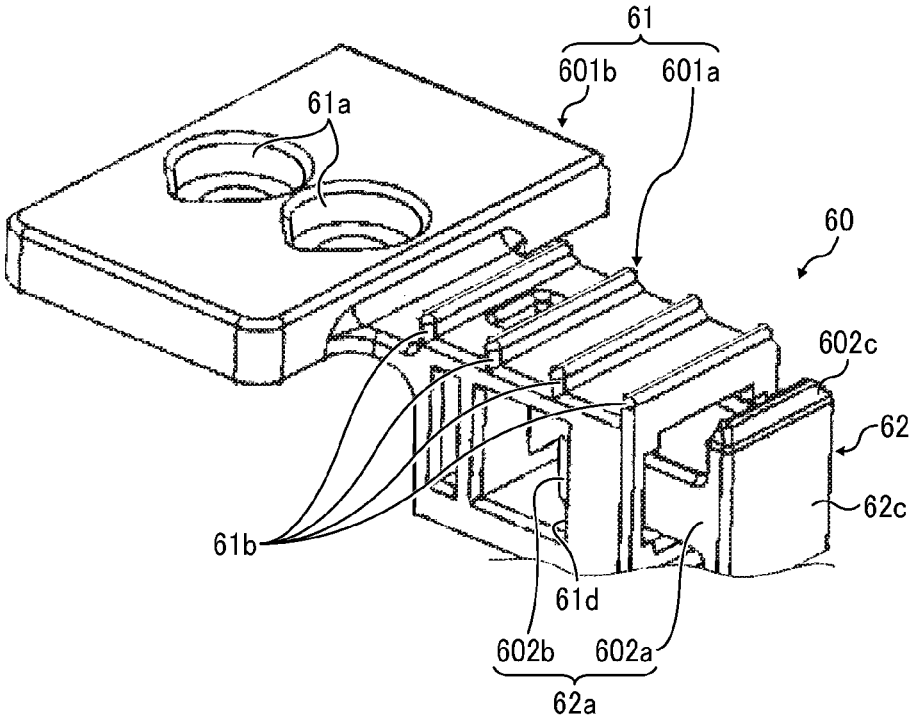
FIG. 9 is a perspective view illustrating the pressure releasing mechanism, viewed from a direction B of FIG. 8.
Figure 10:
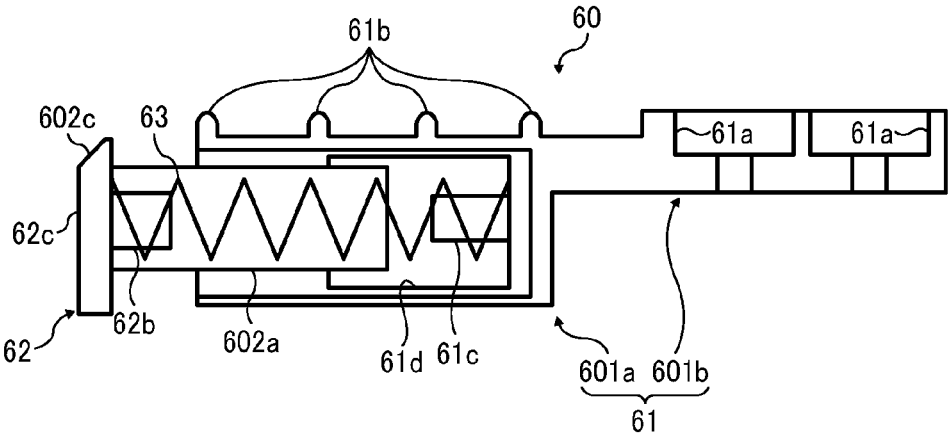
FIG. 10 is a schematic cross sectional view illustrating the pressure releasing mechanism.

FIG. 8 is a perspective view illustrating the pressure releasing mechanism 60. FIG. 9 is a perspective view illustrating the pressure releasing mechanism 60, viewed from a direction G of FIG. 8. FIG. 10 is a schematic cross sectional view illustrating the pressure releasing mechanism 60.

The pressure releasing mechanism 60 that functions as a pressing force releasing unit includes a releasing member 62, a release holding member 61 that holds the releasing member 62 slidable in the sheet width direction, and a release spring 63.

The releasing member 62 includes a releasing portion 62*c*, a snap fit 62*a*, and a release spring holding projection 62*b*. The releasing portion 62*c* contacts the pressing member 9 and releases a pressing force applied by the pressing member 9 to the sheet. When the number of sheets left on the bottom plate 3 is smaller than a predetermined value or approaches zero sheet to be the sheet empty state, the releasing portion 62*c* contacts the pressing member 9 to release a pressing force applied by the pressing member 9 to the sheets. The upper part of the releasing portion 62*c* includes a sloped face 602*c* that separates from the pressing side fence 7*a* as advances upwards.

The snap fit 62*a* is a portion to attach the releasing member 62 to the release holding member 61 to be movable in the sheet width direction. The snap fit 62*a* is provided to the upstream end and downstream end of the releasing member 62 in the sheet conveying direction. The snap fit 62*a* is elastically bendable in the sheet conveying direction and includes a planar portion 602*a* and a claw 602*b*. The planar portion 602*a* extends from the releasing portion 62*c* to the sheet width direction. The claw 602*b* is mounted on a leading edge of the planar portion 602*a*.

The release spring holding projection 62*b* holds one end of the release spring 63 and is mounted on an opposite face to a face of the releasing portion 62*c* to contact the pressing member 9.

The release holding member 61 includes a securing portion 601*b* and a holding portion 601*a*. The securing portion 601*b* is fixed to the bottom plate 3. The holding portion 601*a* holds the releasing member 62. The securing portion 601*b* includes two recessed attaching portions 61*a* aligned in the sheet width direction. A through hole through which a screw penetrates is formed at a center part of the attaching portions 61*a*. Further, each of the attaching portions 61*a* is tapered as advances to a downstream side in the sheet conveying direction as illustrated by arrow E of FIG. 8. This configuration can prevent the sheet from being caught by the attaching portions 61*a* when the sheet bundle is transferred from the sheet supply tray 2 to the sheet feed tray 1.

The holding portion 601*a* has a rectangular cylindrical shape to hold the release spring 63 and the releasing member 62. The holding portion 601*a* includes a release spring holding projection 61*c* to which the opposed end of the release spring 63 is fitted. Further, an opening 61*d* is formed at both side faces of the holding portion 601*a* perpendicular to the sheet conveying direction.

Further, multiple ribs 61*b* that extend in the sheet conveying direction are aligned on the upper face of the holding portion 601*a*. By providing the multiple ribs 61*b*, the sheet can be prevented from falling in the pressure releasing mechanism attaching portion 3*b* when the sheet bundle is transferred to the pressure releasing mechanism attaching portion 3*b*. Therefore, this configuration can prevent the sheet bundle from being caught by the pressure releasing mechanism attaching portion 3*b*.

The opposed end of the release spring 63 is held by fitting to the release spring holding projection 61*c* of the holding portion 601*a*. One end of the release spring 63 is fitted to the release spring holding projection 62*b* of the releasing member 62. Then, while pressing the release spring 63, the releasing member 62 is inserted into the holding portion 601*a*. Consequently, the planner portion 602*a* of the snap fit 62*a* elastically bends toward an inner side, and the claw 602*b* is inserted into the holding portion 601*a*. Then, when the claw 602*b* reaches the opening 61*d* of the holding portion 601*a*, the elastic deformation of the planar portion 9*c* is released, and the claw 602*b* comes to face the edge of the opening 61*d* on the pressing side fence 7*a*. Accordingly, the releasing member 62 is retained by the holding portion 601*a* without being pulled out from the holding portion 601*a* due to the biasing force applied by the release spring 63. Further, the releasing member 62 is movably retained in a range of a length of the opening 61*d* in the sheet width direction.

As described above, by removably retaining the releasing member 62 in the sheet width direction, this configuration can achieve the following effects. When the pressure releasing mechanism 60 is located close to the pressing side fence 7*a* from the predetermined position due to manufacturing error and assembling error and contacts the pressing side fence 7*a*, the releasing member 62 is pressed into the holding portion 601*a* by the pressing side fence 7*a*. According to this configuration, even if the releasing member 62 contacts the pressing side fence 7*a*, the contact pressure of the releasing member 62 with the pressing side fence 7*a* does not increase beyond a predetermined amount. Therefore, an elevating load of the bottom plate 3 can be restrained to the minimum amount when the releasing member 62 contacts the pressing side fence 7*a*. Further, the releasing member 62 is preferably formed by resin material having high slidability such as self-lubricating resin. Accordingly, the elevating load of the bottom plate 3 can be further restrained when the releasing member 62 contacts the pressing side fence 7*a*.

The biasing force of the release spring 63 is set greater than the biasing force of the pressure spring 75. With this configuration, the pressing member 9 can be pressed by the releasing member 62 to the pressing side fence 7*a*, and therefore the pressing force applied by the pressing member 9 to the sheet can be released.

According to the setting position of the pressing side fence 7*a*, the pressure releasing mechanism 60 matches one of through holes of the attaching portions 61*a* with the screw hole of the bottom plate 3. The screw goes through the through hole to secure the screw to the side fence 7*a* of the bottom plate 3. After the position of the pressing side fence 7*a* has been changed, the pressure releasing mechanism 60 is slid in the sheet width direction to the bottom plate 3 so as to change the attaching portions 61*a* to which the screw is inserted. According to this configuration, even if the position of the pressing side fence 7*a* in the sheet width direction is changed, the releasing member can be pressed against the pressing member 9, and therefore the pressure releasing mechanism 60 can release the pressing force applied by the pressing member 9 to the sheet.

Figure 11A:
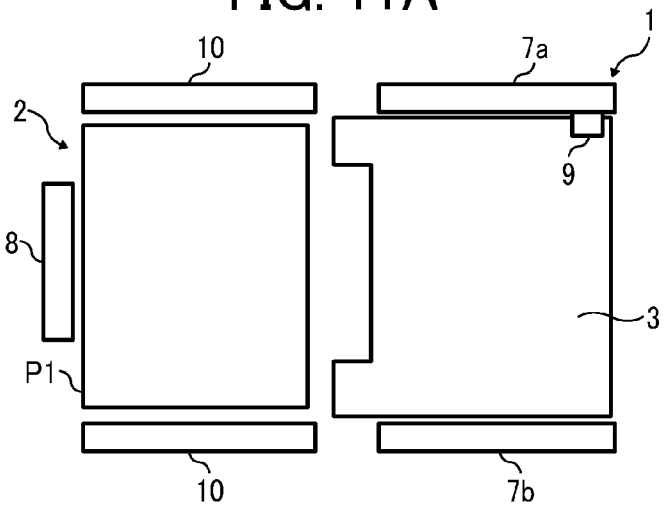
FIG. 11A is a plan view illustrating a schematic configuration of the tandem sheet tray in a state in which no sheet is left on the sheet feed tray and the bottom plate is lowered to the lowest position.
Figure 11B:
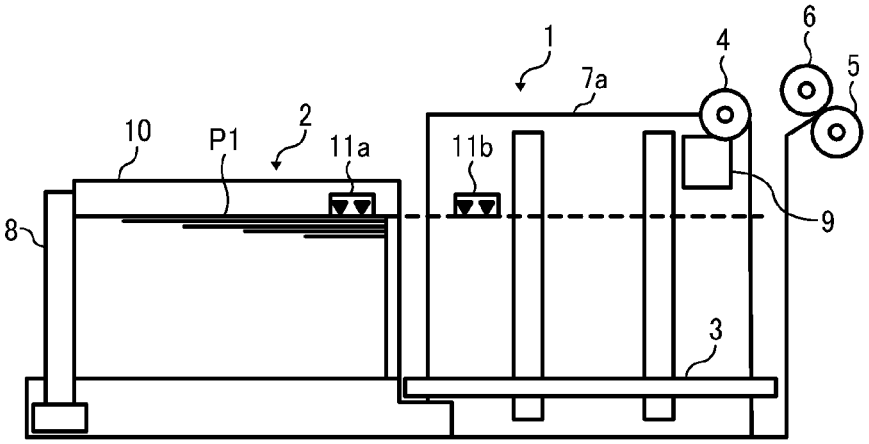
FIG. 11B is a cross sectional view illustrating a schematic configuration of the tandem sheet tray of FIG. 11A.

FIG. 11A is a plan view illustrating a schematic configuration of the tandem sheet tray 114*a* in a state in which no sheet is left on the sheet feed tray 1 and the bottom plate 3 is lowered to the lowest position. FIG. 11B is a cross sectional view illustrating a schematic configuration of the tandem sheet tray 114*a* of FIG. 11A.

As illustrated in FIG. 11B, a pair of side fences 10 of the sheet supply tray 2 has a mark 11*a* and the side fences 7*a* and 7*b* of the sheet feed tray 1 has a mark 11*b*. As indicated by a broken line in FIG. 11B, the pressing member 9 is located above the sheet full position that is indicated by the mark 11*a* of the pair of side fences 10 of the sheet supply tray 2. In the present embodiment, the mark 11*a* specifies the sheet full position of the sheet supply tray 2 but the indication of the sheet full position is not limited thereto. For example, pair of side fences 10 of the sheet supply tray 2 may have eaves at a position that does not interfere a loading operation of the sheet bundle, so as to indicate the sheet full position. It is to be noted that the sheet full position of the sheet feed tray 1 is located below the pressing member 9. By so doing, a setting error of a sheet due to the pressing member 9 can be avoided when a user sets the sheet bundle to the sheet feed tray 1.

Figure 12A:
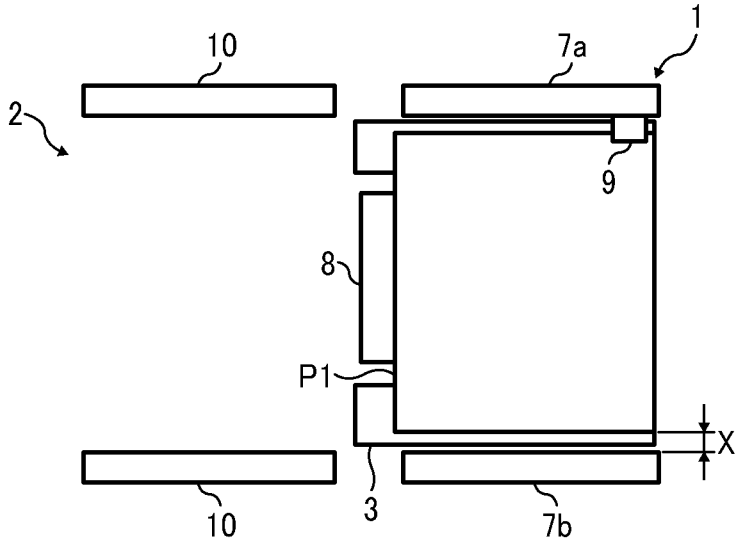
FIG. 12A is a plan view illustrating a schematic configuration of the tandem sheet tray in a state in which the sheet bundle of the sheet supply tray is transferred to the sheet feed tray.
Figure 12B:
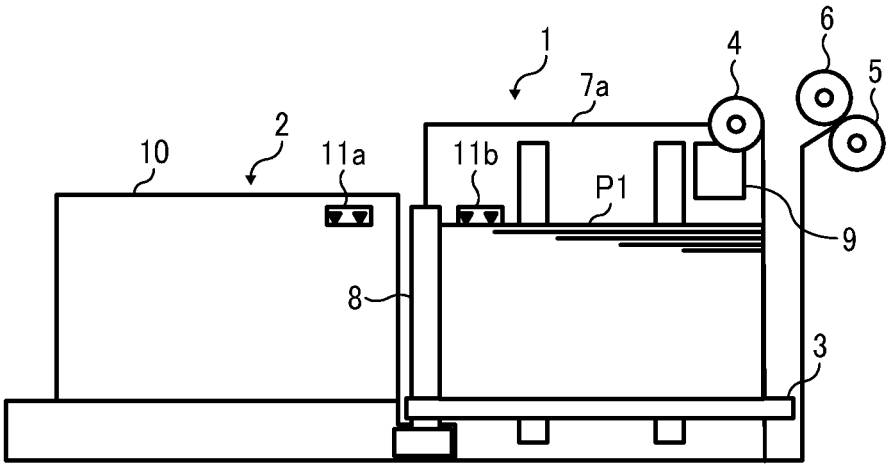
FIG. 12B is a cross sectional view illustrating the tandem sheet tray of FIG. 12A.

FIG. 12A is a plan view illustrating a schematic configuration of the tandem sheet tray 114*a* in a state in which the sheet bundle P1 of the sheet supply tray 2 is transferred to the sheet feed tray 1. FIG. 12B is a cross sectional view illustrating the tandem sheet tray 114*a* of FIG. 12A.

As illustrated in FIG. 12A, the pressing member 9 is disposed projecting from the pressing side fence 7*a*. In addition, as described above, the pressing member 9 is located above the sheet full position of the sheet supply tray 2. Accordingly, the pressing member 9 is located above the top of the sheet bundle to be transferred to the sheet feed tray 1, and therefore the sheet bundle is not caught by the pressing member 9 when the sheet transfer fence 8 transfers the sheet bundle. Consequently, this configuration can prevent movement of the sheet bundle from that part of the sheet bundle is hindered by the pressing member 9 when the sheet bundle is transferred to the sheet feed tray 1.

Further, the side fence 7*b*, which is hereinafter referred to as the regulating side fence 7*b*, is not provided with the pressing member 9. A distance between the pressing side fence 7*a* and the regulating side fence 7*b* is set longer than the predetermined sheet width in view of cutting error of the sheet bundle. Therefore, as illustrated in FIG. 12A, a gap X is formed between the sheet bundle transferred from the sheet supply tray 2 and each of the side fences 7*a* and 7*b*.

Figure 13A:
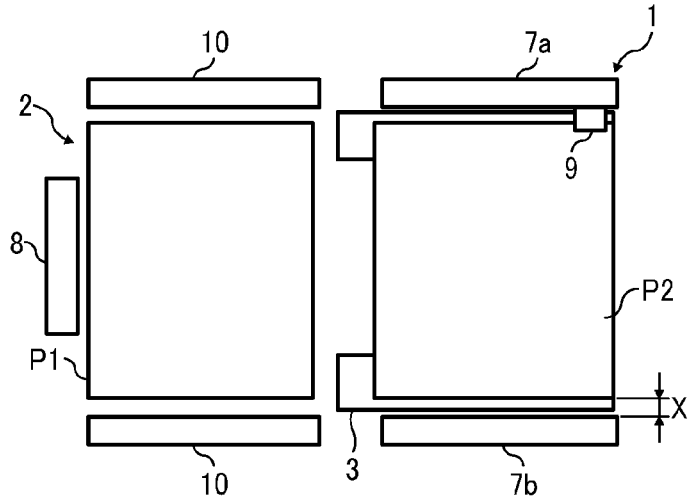
FIG. 13A is a plan view illustrating a schematic configuration of the tandem sheet tray immediately before the bottom plate is elevated.
Figure 13B:
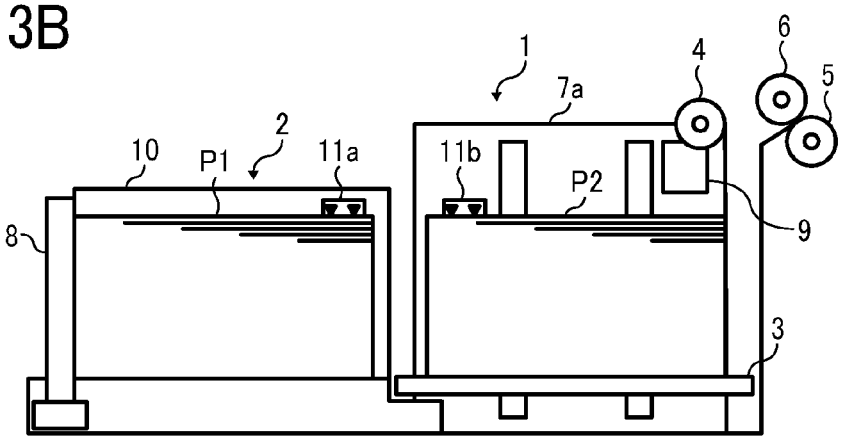
FIG. 13B is a cross sectional view illustrating the tandem sheet tray of FIG. 13A.
Figure 13C:
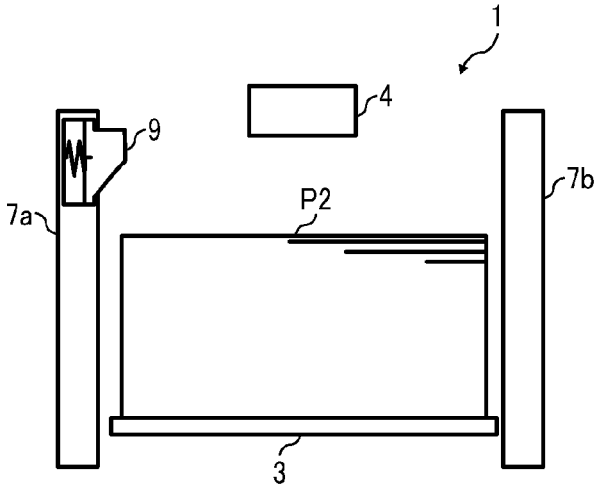
FIG. 13C is a front view illustrating the tandem sheet tray of FIG. 13A.
Figure 14A:
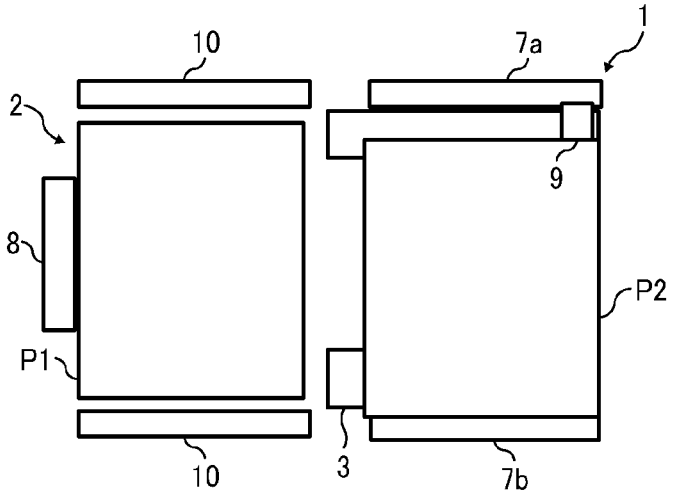
FIG. 14A is a plan view illustrating a schematic configuration of the tandem sheet tray that is ready to feed a sheet.
Figure 14B:
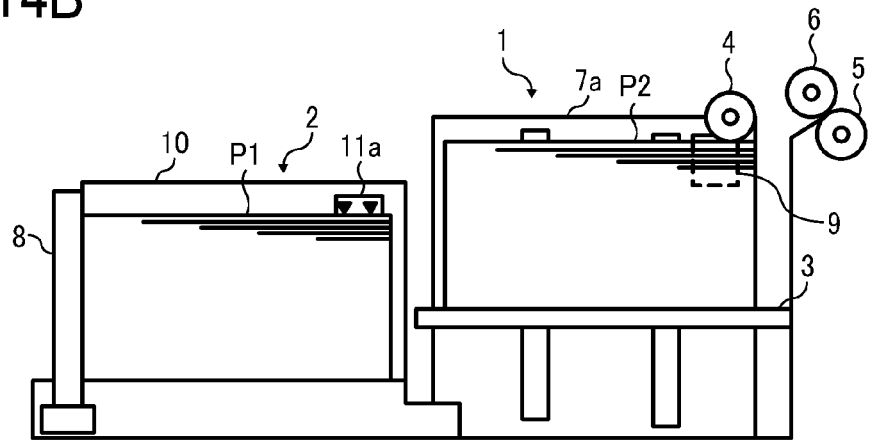
FIG. 14B is a cross sectional view illustrating the tandem sheet tray of FIG. 14B.
Figure 14C:
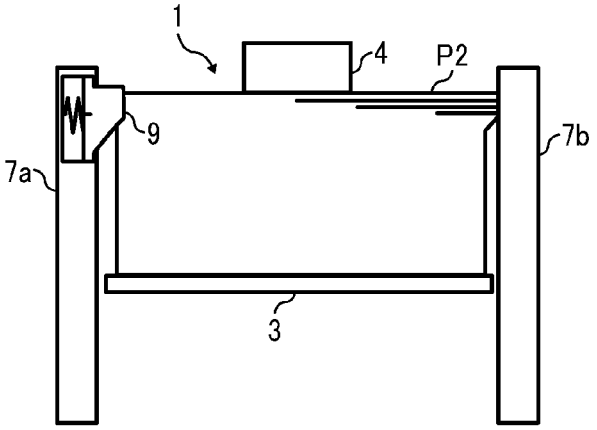
FIG. 14C is a front view illustrating the tandem sheet tray of FIG. 14A.

FIG. 13A is a plan view illustrating a schematic configuration of the tandem sheet tray 114*a* immediately before the bottom plate 3 is elevated. FIG. 13B is a cross sectional view illustrating the tandem sheet tray 114*a* of FIG. 13A. FIG. 13C is a front view illustrating the tandem sheet tray 114*a* of FIG. 13A. FIG. 14A is a plan view illustrating a schematic configuration of the tandem sheet tray 114*a* that is ready to feed a sheet. FIG. 14B is a cross sectional view illustrating the tandem sheet tray 114*a* of FIG. 14B. FIG. 14C is a front view illustrating the tandem sheet tray 114*a* of FIG. 14A.

As illustrated in FIGS. 13A through 13C, after the sheet bundle has been transferred to the sheet supply tray 2, the sheet transfer fence 8 is returned to the home position. Thereafter, a new sheet bundle is loaded on the sheet supply tray 2 to start elevating the bottom plate 3. A sheet feeding position of the sheet pickup roller 4 is located further upper than the pressing position of the pressing member 9. Therefore, when the bottom plate 3 is located at the lowest position, the uppermost sheet of the sheet bundle that has been transferred from the sheet supply tray 2 is not in contact with the sheet pickup roller 4. Therefore, the bottom plate 3 is elevated to cause the sheet ready to be fed.

As the bottom plate 3 elevates, the sheet bundle P2 comes into contact with the sloped face 9*b* of the pressing portion 91 of the pressing member 9, as illustrated in FIG. 7. Under this state, as the bottom plate 3 further elevates, the biasing force (the pressing force) applied by the pressure spring 75 presses the uppermost sheet placed on top of the sheet bundle P2. Then, the uppermost sheet is pressed to the regulating side fence 7*b*, and one end in the width direction of the uppermost sheet contacts the regulating side fence 7*b*. Consequently, the position in the width direction of the sheet is regulated.

Further, in the present embodiment, by providing the sloped face 9*b*, as the bottom plate 3 is moved upwards, the sheet can be shifted to the regulating side fence 7*b* smoothly. Further, in the state of FIG. 7B, the lower end of the sloped face 9*b* is located in the pressing side fence 7*a*. Accordingly, when the bottom plate 3 comes upwards, the sheet can contact the sloped face 9*b* reliably.

Due to cutting errors in sheet production, each bundle of sheets to be set in the second sheet container has predetermined variations in the sheet width with respect to a predetermined sheet width. Therefore, in a comparative sheet containing device, when a distance between a pair of side fences when located at a regulating position is set to a predetermined width of a sheet, the following failure occurs. Specifically, in a case in which the width of a bundle of sheets transferred from the second sheet container to the first sheet container is greater than a predetermined width, if the pair of side fences is moved either to a retreating position or to a regulating position, both ends in the width direction of the bundle of sheets contact respective side fences of the pair of side fences before the pair of side fences reaches the regulating position. If the pair of side fences is further moved to the regulating position from this state, the bundle of sheets accommodated in the first sheet container is pressed by the pair of side fences, and eventually the bundle of sheets is bent or warped by the pair of side fences.

In addition, when multiple sheets of the sheet bundle contact the regulating side fence 7*b*, the pressing member 9 is pushed into the pressing member holding opening 71 against the biasing force of the pressure spring 75 due to the rigidity of the multiple sheets. Accordingly, the sheets that contact the regulating side fence 7*b* are not bent due to the pressing force of the pressing member 9.

Further, if the bottom plate 3 is elevated in a state in which the sheet bundle is in contact with the sloped face 9*b*, the pressing force is applied to the pressing member 9 in an upward direction. As a result, it is likely that the pressing member 9 rotates in such a way that the pressing portion 91 of the pressing member 9 is lifted upwards by the sheet bundle. If the pressing member 9 rotates, the pressing member 9 cannot be moved in the sheet width direction smoothly. As a result, the pressing member 9 cannot be pressed into the pressing member holding opening 71 by the rigidity of the multiple sheets pressed against the regulating side fence 7*b*. Therefore, it is likely that the sheet is bent or warped.

In order to address this inconvenience, a distance between the side fences of the pair of side fences at the regulating position is set greater than the predetermined width, in view of the minimum value of the tolerance in the width direction of the bundle of sheets. However, when the width of the bundle of sheets transferred to the first sheet container corresponds to the predetermined width or is smaller than the predetermined width by the tolerance, a gap is formed between the sheet and the pair of side fences. Therefore, the position in the width direction of the sheet cannot be regulated. As a result, these bundles of sheets have variations of the sheet conveying position in the width direction of the sheet.

By contrast, as illustrated in FIG. 7C, the pressing member 9 according to the present embodiment includes a guide projection 9*e* that extends in the sheet width direction and is inserted into guide groove 71*b*. According to this configuration, when the sheet bundle applies a force to move the pressing portion 91 upwards, the guide projection 9*e* contacts the upper part of the guide groove 71*b*, thereby preventing rotation of the pressing member 9. Accordingly, due to the rigidity of the multiple sheets pressed against the regulating side fence 7*b*, the pressing member 9 can be pushed into the pressing member holding opening 71 smoothly. Therefore, the sheets of the sheet bundle can be prevented from being bent.

As illustrated in FIG. 14B, when the bottom plate 3 is lifted to the sheet feeding position where the uppermost sheet of the sheet bundle P2 comes to contact with the sheet pickup roller 4, the bottom plate 3 stops elevating. At this time, the position of the uppermost sheet of the sheet bundle P2 is restricted in the sheet width direction by the pressing member 9 and the regulating side fence 7*b*. Consequently, the uppermost sheet of the sheet bundle P2 is fed with the position in the sheet width direction restricted. Accordingly, variation of the sheet conveying position in the sheet conveying direction can be restrained, and therefore an image forming position to the sheet can be prevented from being varied in the sheet width direction.

Further, by locating the pressing member 9 below the sheet feeding position, the pressing member 9 can press the sheet against the regulating side fence 7*b* in the process in which the bottom plate 3 is lifted to cause the uppermost sheet of the sheet bundle loaded on the bottom plate 3 to contact the sheet pickup roller 4.

Further, in the present embodiment, as illustrated in FIGS. 14B and 14C, the position and length in the vertical direction of the pressing member 9 are arranged so that the upper sheets placed on the upper part of the sheet bundle are pressed. The sheets in the lower part of a sheet bundle have a greater load than the sheets in the upper part of the sheet bundle, and therefore the sheet in the lower part of the sheet bundle cannot move easily. For example, in a case in which a sheet in the lower part of a sheet bundle is misaligned toward the pressing side fence, the sheet cannot be pulled and adjusted to the correct position by the pressing force of the pressing member, and therefore it is likely that the projecting portion of the sheet is bent. By contrast, the pressing member 9 presses the upper sheets of the sheet bundle in the present embodiment. Therefore, when the sheet projecting toward the pressing side fence is pressed by the pressing member, the sheet can be shifted by the pressing force of the pressing member easily, thereby preventing the sheet from being bent. Further, by pressing the upper sheets of the sheet bundle, the sheet can be pushed into the regulating side fence with a small pressing force, and therefore the sheet can be pressed against the regulating side fence.

As the amount of sheets loaded on the bottom plate 3 becomes smaller, the number of sheets to be pressed by the pressing member 9 is reduced. As the amount of sheets to be pressed by the pressing member 9 reduces, the sheet cannot hold against the pressing force applied by the pressing member 9, and therefore the sheet is bent. Once the sheet is bent, a sheet feed failure occurs and the transfer position of the sheet can shift significantly in the sheet width direction. However, the pressure releasing mechanism 60 is provided in the present embodiment to release the pressurization to the sheet when the number of sheets loaded on the bottom plate 3 is smaller than the predetermined value or approaches zero sheet to be the sheet empty state.

Figure 15A:
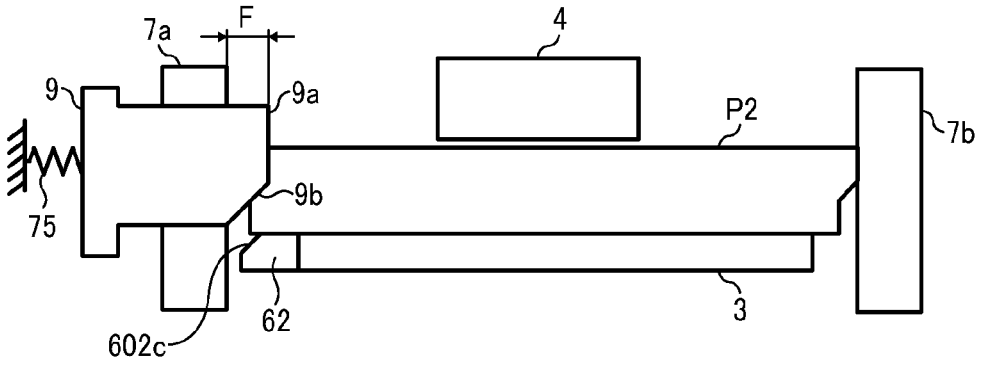
FIGS. 15A, 15B, and 15C are diagrams illustrating steps of the pressure relief performed by the pressure releasing mechanism.
Figure 15B:
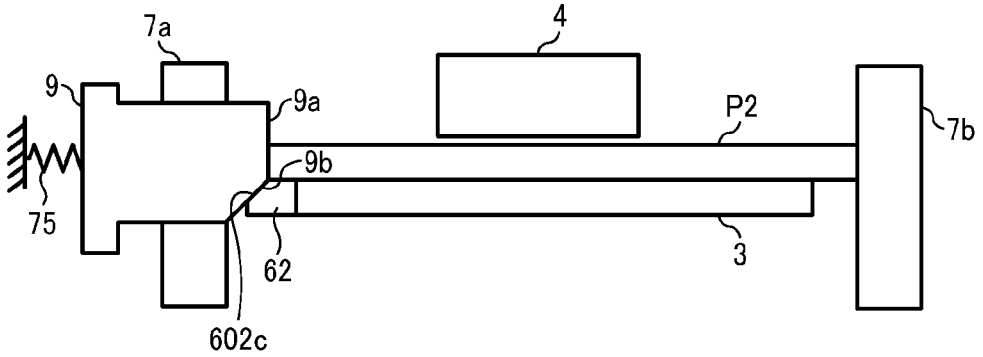
Figure 15C:
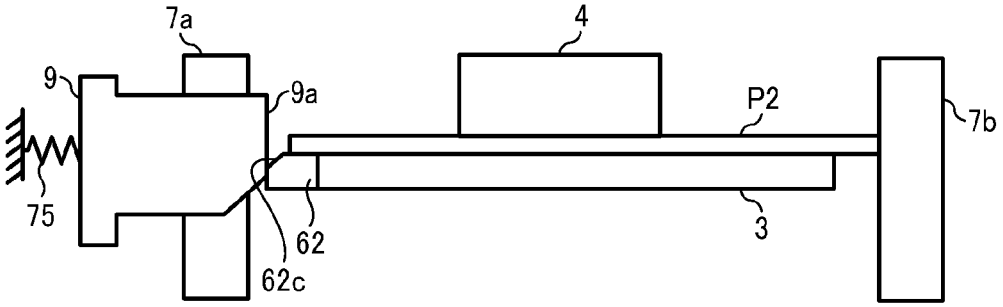
Figure 16:
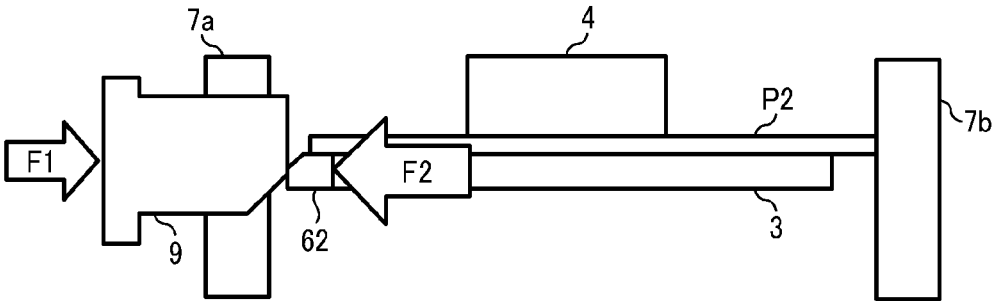
FIG. 16 is a diagram illustrating a biasing force applied by a release spring and a biasing force applied by a pressure spring.

FIGS. 15A, 15B, and 15C are diagrams illustrating steps of the pressure relief performed by the pressure releasing mechanism 60. FIG. 16 is a diagram illustrating a biasing force applied by the release spring 63 and a biasing force applied by a pressure spring.

As illustrated in FIG. 15A, when the large number of sheets are loaded on the bottom plate 3, the releasing member 62 of the pressure releasing mechanism 60 is not in contact with the pressing member 9. The pressing member 9 is disposed projecting from the pressing side fence by F mm, so that the multiple sheets contact the regulating side fence 7*b*.

As the sheet loaded on the bottom plate 3 is fed by the sheet pickup roller 4, the bottom plate 3 is elevated gradually. Then, the upper face of the bottom plate 3 reaches the lower end of the pressing face 9*a* of the pressing member 9, as illustrated in FIG. 15B. When the bottom plate 3 reaches this position, the sloped face 602*c* of the releasing member 62 contacts the sloped face 9*b* of the pressing member 9. When the bottom plate 3 reaches the lower end of the pressing face 9*a* of the pressing member 9, the pressing face 9*a* of the pressing member 9 presses the sheet located at the lowest part on the bottom plate 3 against the regulating side fence 7*b*. Accordingly, the whole sheets loaded on the bottom plate 3 comes to contact with the regulating side fence 7*b*.

As illustrated in FIG. 16, a biasing force F2 applied by the release spring 63 is greater than a biasing force F1 applied by the pressure spring. Therefore, when the bottom plate 3 is elevated from the state in FIG. 15B, the pressing member 9 is pressed into the pressing side fence 7*a* by the biasing force of the release spring 63. Then, as illustrated in FIG. 15C, the pressing member 9 separates form the sheet on the bottom plate 3, and therefore the pressing force is canceled. Accordingly, when the number of sheets loaded on the bottom plate 3 becomes small, the pressing member 9 can prevent the sheet from being bent or warped by the pressing force. Further, before the releasing member 62 cancels the pressing force, the whole sheets loaded on the bottom plate 3 are pressed to the regulating side fence 7*b*, so that the position of the sheet bundle in the sheet width direction is aligned. Therefore, the sheets of the sheet bundle can be conveyed to the last sheet without the sheet feeding position varying in the sheet width direction. Accordingly, an image can be formed on the predetermined image forming position of the sheet.

It is to be noted that one or a single pressing member 9 is provided in the above-described embodiment but the configuration is not limited thereto. For example, multiple pressing members 9 can be arranged in the sheet conveying direction.

Figure 17A:
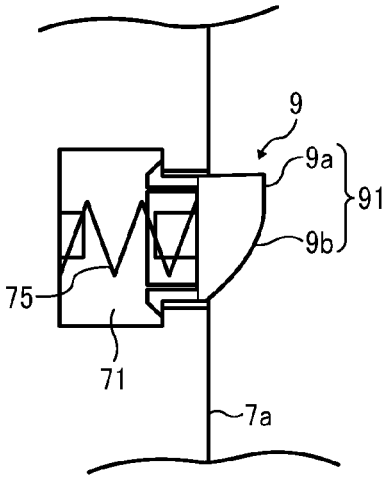
FIG. 17A is a diagram illustrating an example of a pressing member having a curved sloped face.
Figure 17B:
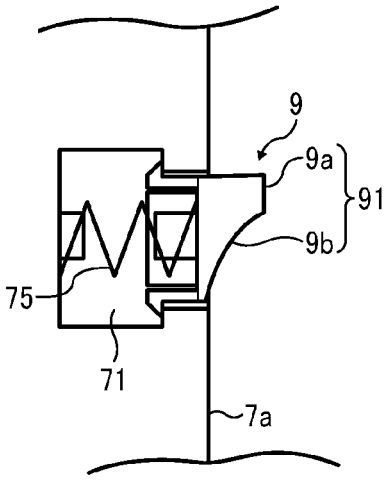
FIG. 17B is a diagram illustrating the sloped face of the pressing member is an inwardly curved face.

Further, FIG. 17A is a diagram illustrating the sloped face 9*b* of the pressing member 9 is an outwardly curved face. FIG. 17B is a diagram illustrating the sloped face 9*b* of the pressing member 9 is an inwardly curved face. It is to be noted that the sloped face 9*b* of the pressing member 9 according to the present embodiment has a flat face. However, the sloped face 9*b* is not limited thereto and can have a curved face. For example, the sloped face 9*b* can be an outwardly curved face as illustrated in FIG. 17A or an inwardly curved face as illustrated in FIG. 17B.

Further, since the upper sheets of the sheet bundle are pressed in the configuration of the present embodiment, the sheets can be pressed against the regulating side fence 7*b* with a pressing force smaller than a configuration in which the whole sheet bundle is pressed. Accordingly, when the number of sheets loaded on the pressure releasing mechanism 60 becomes small, the pressing member 9 can prevent the sheet from being bent or warped by the pressing force even without the pressure releasing mechanism 60. However, it is preferable to provide the pressure releasing mechanism 60, so that the biasing force applied by the pressure spring can be designed roughly.

Next, a description is given of a pressing member 901 according to variations based on the pressing member 9.

Variation 1.

Figure 18:
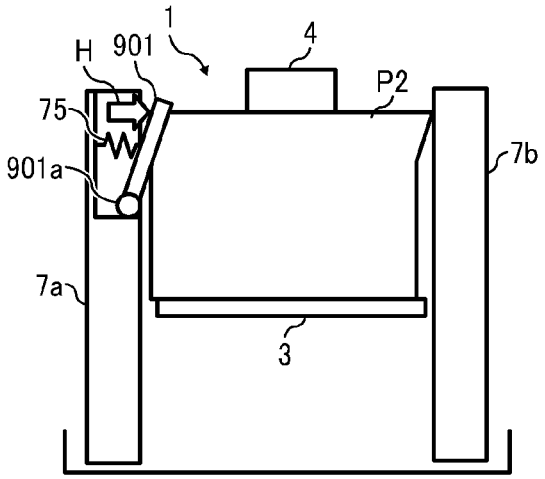
FIG. 18 is a schematic view illustrating a configuration of a pressing member according to Variation 1.

FIG. 18 is a schematic view illustrating a configuration of a pressing member 901 according to Variation 1.

The pressing member 901 according to Variation 1 is a planar member that extends in a vertical direction. The lower end of the pressing member 901 is rotatably attached to the pressing side fence 7*a* in a predetermined range. Consequently, the upper part of the pressing member 901 contacts the pressure spring 75 to bias the upper part of the pressing member 901 toward the regulating side fence 7*b* as indicated by arrow H in FIG. 18. Due to the biasing force of the pressure spring 75, the upper part of the pressing member 901 projects from the pressing side fence 7*a*. That is, in Variation 1, the upper part of the pressing member 901 functions as a projection.

In Variation 1, as the bottom plate 3 elevates, the upper sheets of the sheet bundle are pressed by the upper part of the pressing member 901 against the regulating side fence 7*b*, and therefore contact the regulating side fence 7*b*. Accordingly, the position of the sheet bundle in the sheet width direction is regulated by the pressing member 901 and the regulating side fence 7*b*.

Further, when multiple sheets of the sheet bundle contact the regulating side fence 7*b*, the pressing member 901 is rotated about a shaft 901*a* in a counterclockwise direction in FIG. 18 to move into the pressing side fence 7*a*. Accordingly, the sheets that have contacted the regulating side fence 7*b* are not bent due to the pressing force applied by the pressing member 901.

In Variation 1, even if a guide mechanism (i.e., the guide projection 9*e* and the guide groove 71*b*) is not provided, the pressing member 901 can be moved toward the pressing side fence 7*a*. Further, when the pressing member is shifted to the pressing side fence, a sliding resistance between a pressing member and a pressing side fence can be reduced when compared with a configuration in which a pressing member is slid in the sheet width direction. Accordingly, the pressing member can be shifted preferably to the pressing side fence, and the sheet that is pressed by the pressing member 901 can be prevented from bending or warping.

Variation 2.

Figure 19:
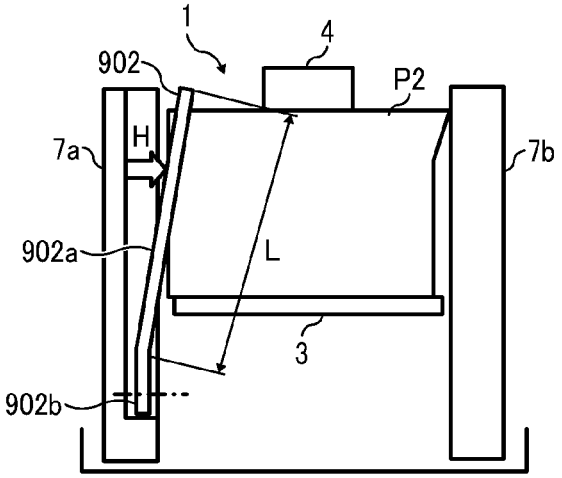
FIG. 19 is a schematic view illustrating a configuration of a pressing member according to Variation 2.

FIG. 19 is a schematic view illustrating a configuration of a pressing member 902 according to Variation 2.

In Variation 2, the pressing member 902 includes a thin plate member to press the sheets using an elastic force applied by the pressing member 902.

The pressing member 902 of Variation 2 includes an attaching portion 902*a* and a leaf spring 902*b* that is a thin plate member having the elasticity to bend in the vertical direction. The attaching portion 902*a* is disposed at the lower end of the pressing member 902 to be attached to the pressing side fence 7*a*. The leaf spring 902*b* inclines from the attaching portion 902*a* toward the regulating side fence 7*b* as indicated by arrow H in FIG. 19. The upper part of the leaf spring 902*b* projects from the pressing side fence 7*a*.

The material and thickness of the pressing member 902 and a length L of the leaf spring 902*b* are adjusted appropriately so as to have a proper pressing force. Further, it is preferable that the leaf spring 902*b* has a relatively long length. By setting the length of the leaf spring 902*b* relatively long, the spring constant of the leaf spring 902*b* can be reduced. Therefore, an increase in resilience of the leaf spring 902*b* generated when the leaf spring 902*b* is pressed against the pressing side fence 7*a* can be restrained. Accordingly, the sheet in contact with the regulating side fence 7*b* can be prevented from being bent due to the pressing force applied by the pressing member 902. Especially, when the tandem sheet tray 114*a* can contain a large number of sheets, the vertical length of each of the side fences is relatively long. Therefore, it is preferable that the length L of the leaf spring 902*b* is also relatively long.

The materials of the pressing member 902 are, for example, PET (polyester) film, SUS, and the like. However, it is preferable that the pressing member 902 includes a SUS plate in view of workability and procurement performance of supplies. Further, when a SUS plate is used, it is not preferable in view of safety that a thin metal is exposed at a portion where a user may contact or touch. Therefore, it is preferable to remove burred and edge parts. Further, when the biasing force of the leaf spring 902*b* is small, sponge or rubber are interposed between the leaf spring 902*b* and the pressing side fence 7*a* to adjust to a desired pressing force. The pressing member 902 is fixed to the pressing side fence 7*a* with screws.

Figure 20:
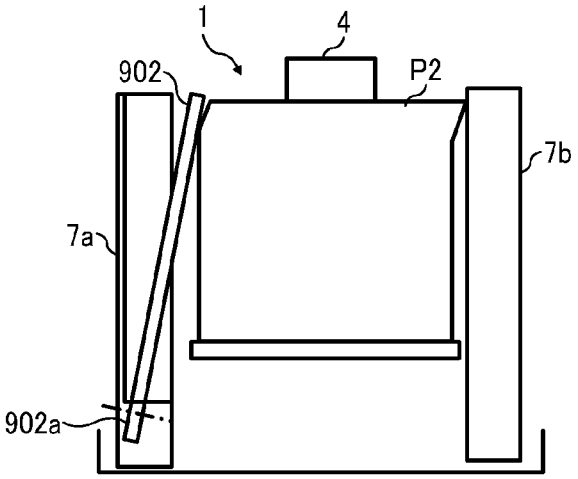
FIG. 20 is a diagram illustrating an example of attachment of the pressing member of Variation 2 to the pressing side fence.

FIG. 20 is a diagram illustrating an example of attachment of the pressing member 902 of Variation 2 to the pressing side fence 7*a*. As illustrated by a broken line in FIG. 20, a fixing screw hole formed on the pressing side fence 7*a* to secure the pressing member 902 is inclined in the vertical direction, so that the pressing member 902 can be attached to the pressing side fence 7*a* in a state in which the pressing member 902 is tilted in the vertical direction. According to this configuration, a pressing member can be a straight thin plate member and the upper part of the pressing member can project from the pressing side fence 7*a*. Accordingly, different from the pressing member 902 illustrated in FIG. 19, the pressing member 902 including a thin plate member illustrated in FIG. 20 is not machined to be bent. Therefore, the pressing member 902 illustrated in FIG. 20 can achieve a reduction in cost.

Figure 21:
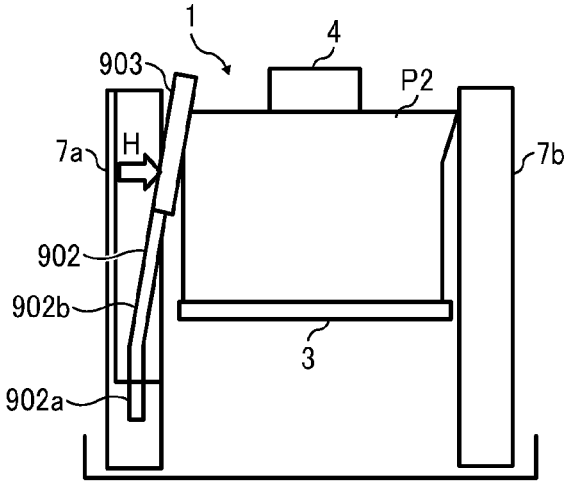
FIG. 21 is a diagram illustrating an example in which the pressing member of Variation 2 includes a low friction member to cover a projecting portion projecting from the pressing side fence of the pressing member of Variation 2.

FIG. 21 is a diagram illustrating an example in which the pressing member 902 includes a low friction member 903 that functions as a cover. As illustrated in FIG. 21, the low friction member 903 covers a projecting portion projecting from the pressing side fence 7*a* of the pressing member 902 of Variation 2. The low friction member 903 includes a self-lubricating resin such as polyoxymethylene (POM), which is known as acetal resin. Accordingly, the sheet can be moved to the regulating side fence 7*b* smoothly as indicated by arrow H in FIG. 21 without being caught by the pressing member. Further, since the upper part of the pressing member 902 of a thin plate member is covered by the low friction member 903, good safety can be achieved.

In Variation 2, as the bottom plate 3 elevates, the uppermost sheet of the sheet bundle comes contact with the pressing member 902, the pressing member 902 is bent toward the pressing side fence. Further, as the pressing member 902 is bent to the pressing side fence 7*a*, the resilience of the pressing member 902 increases. According to this action, the upper sheets of the sheet bundle are moved to the regulating side fence 7*b*. Accordingly, the upper sheets of the sheet bundle contacts the regulating side fence 7*b*, and therefore the position in the sheet width direction of the sheet is restrained by the pressing member 901 and the regulating side fence 7*b*. Accordingly, as the multiple sheets of the sheet bundle contact the regulating side fence 7*b*, the upper part of the pressing member 902 bends toward the pressing side fence 7*a* due to the rigidity of the multiple sheets. Accordingly, the sheets that have contacted the regulating side fence 7*b* are not bent due to the pressing force applied by the pressing member 901.

Further, since the pressing member 902 presses the sheets with the own resilience, the sheets can be pressed without a pressure spring. Therefore, the number of parts can be reduced, and achieve a reduction in cost of the image forming apparatus 100.

Further, in Variation 2, as illustrated in FIGS. 19, 20, and 21, the projecting portion of the pressing member 902 projecting from the pressing side fence 7*a* is located above the sheet full position of the sheet supply tray 2. Therefore, in Variation 2, when the sheet bundle contained in the sheet supply tray 2 is transferred to the sheet feed tray 1, the sheet bundle is not caught by the pressing member 902.

Figure 22A:
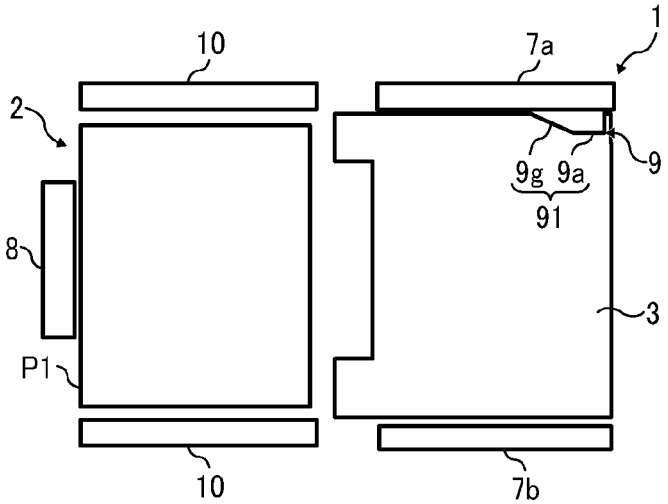
FIG. 22A is a top view illustrating an example of the pressing member including a tapered face on an upstream side of the pressing member in a sheet conveying direction.
Figure 22B:
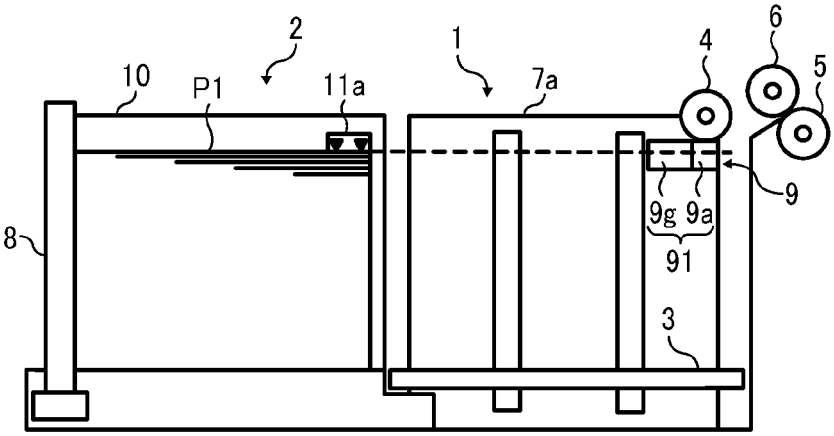
FIG. 22B is a side view illustrating an example of the pressing member of FIG. 22A.

Further, the pressing portion that projects from the pressing side fence 7*a* above the sheet full position of the sheet supply tray 2 is disposed to prevent the sheet bundle from being caught by the pressing portion when the sheet bundle is transferred to the sheet feed tray 1. However, a configuration illustrated in FIGS. 22A and 22B can be also employed. FIG. 22A is a top view illustrating an example of the pressing member 9 including a tapered face on an upstream side of the pressing member 9 in the sheet conveying direction. FIG. 22B is a side view illustrating an example of the pressing member of FIG. 22A.

With the configuration illustrated in FIGS. 22A and 22B, the sheet bundle is not caught by the pressing portion 91 when the sheet bundle is transferred to the sheet feed tray 1. That is, the pressing portion 91 of the pressing member 9 includes a sloped face 9*g*. The sloped face 9*g* approaches to the pressing side fence 7*a* as advances to the sheet supply tray 2 disposed at the upstream side in the sheet conveying direction. In other words, a distance between the sloped face 9*g* and the pressing side fence 7*a* decreases toward to the upstream side in the sheet conveying direction. Accordingly, the sheet bundle being transferred to the sheet feed tray 1 contacts the sloped face 9*g* of the pressing portion 91. As the sheet bundle is further transferred to the sheet feed tray 1 in this state, the sheet that has contacted the sloped face 9*g* of the pressing portion 91 is guided by the sloped face 9*g* to the regulating side fence 7*b*. Accordingly, the sheet being transferred to the sheet feed tray 1 can be transferred smoothly without being caught by the pressing portion 91. Further, when the sheets contact the regulating side fence 7*b* by the sloped face 9*g* of the pressing portion 91, the pressing member 9 moves to the pressing side fence 7*a* due to the rigidity of the sheets. Accordingly, the sheets can be press against the regulating side fence 7*b* without being bent. Further, as illustrated in FIGS. 22A and 22B, the pressing portion 91 is designed to extend short in the vertical direction and contact the upper sheets of the sheet bundle. Accordingly, the sheets can be transferred to the regulating side fence 7*b* with a small pressing force. Further, when the sheets of the sheet bundle contact the regulating side fence 7*b*, the pressing member 9 can move to the pressing side fence 7*a* easily. By so doing, an image forming defect such as skew of the sheets in transfer caused by the pressing member 9 can be prevented.

Further, the above-described configuration includes a pressing member at one side of the secured side fences. However, similar to a comparative sheet containing device, a pressing member is provided to one of the fixed side fences that is movable in the width direction by a motor. In the comparative sheet containing device that includes the pair of side fences movable by the motor, when the sheet bundle of the sheet supply sheet supply tray 2 is transferred to the sheet feed tray 1, the pair of side fences can be moved to the retreating position. Therefore, the sheet bundle is not caught by the pair of side fences when the sheet bundle is transferred. Then, after the sheet bundle has been transferred to the sheet feed tray 1, the motor is driven, and the pair of side fences is moved from the retreating position to a regulating position where the sheet bundle is regulated in the width direction. In a case in which the distance between the pair of side fences located at the regulating position corresponds to the predetermined width of the sheet size, if the sheet bundle has a width greater than the predetermined width due to the sheet cutting error, it is likely that the sheet bundle is bent by being compressed by the pair of side fences. In addition, some motors cannot move the pair of side fences to the regulating position. Therefore, it is likely that the motor or a drive power transmission mechanism that transmits a driving force applied by the motor to the pair of side fences is broken. Accordingly, even in the configuration in which the side fences move automatically, the distance between the side fences at the regulating position is set greater than the predetermined width of the sheets. Consequently, a gap is generated between the sheets in the sheet feed tray and the side fences, and therefore the position in the sheet width direction of the sheet cannot be regulated. As a result, the sheet transferring position varies in the sheet width direction.

Therefore, even in the configuration in which a pair of side fences can move automatically, by providing a pressing member to one of the pair of side fences, the pressing member presses the sheets to the other of the pair of side fences, so that the position in the width direction of the sheets can be regulated. Accordingly, the position of the sheets to be transferred can be prevented from varying in the sheet width direction. Further, even in the configuration in which the pair of side fences can move automatically, it is preferable that the pressing member presses the upper sheets of the sheet bundle. Since the pressing member presses the upper sheets of the sheet bundle, when a sheet that projects toward the pressing side fence is pressed by the pressing member, the sheet can be moved by the pressing force applied by the pressing member easily. Therefore, the sheet is prevented from being bent.

Next, a description is given of a pressure assist member 910, with reference to FIGS. 23A, 23B, 24A, 24B, and 24C. The pressure assist member 910 may be included in the sheet feed tray 1 of the present embodiment to support the pressing force (the biasing force) of the pressing member 9 to the sheet.

Figure 23A:
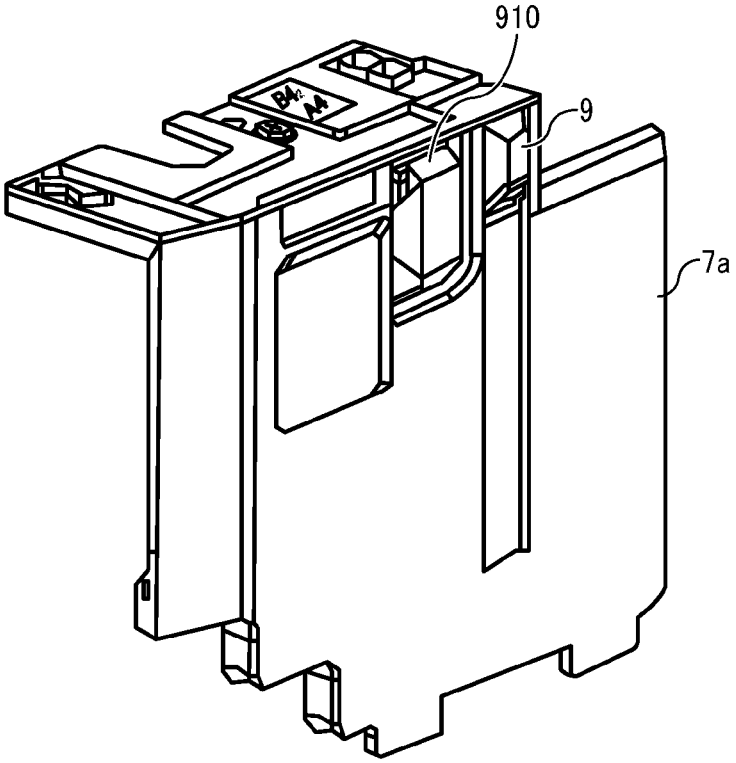
FIG. 23A is a perspective view illustrating a pressure assist member mounted on the pressing side fence.
Figure 23B:
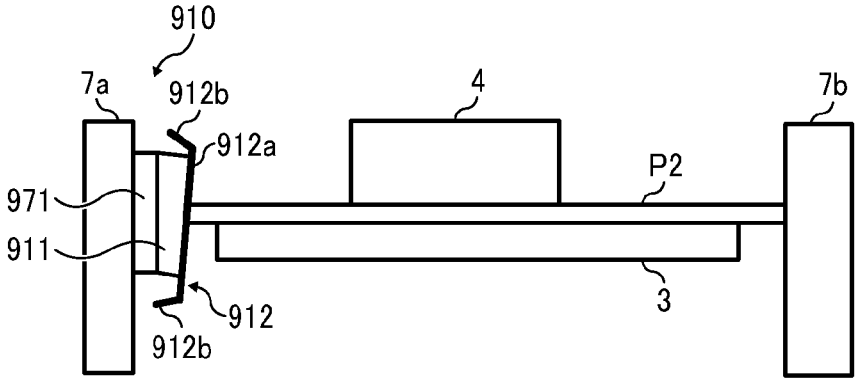
FIG. 23B is a diagram illustrating the pressure assist member and a vertical relation of a sheet bundle and the pressure assist member.
Figure 24A:
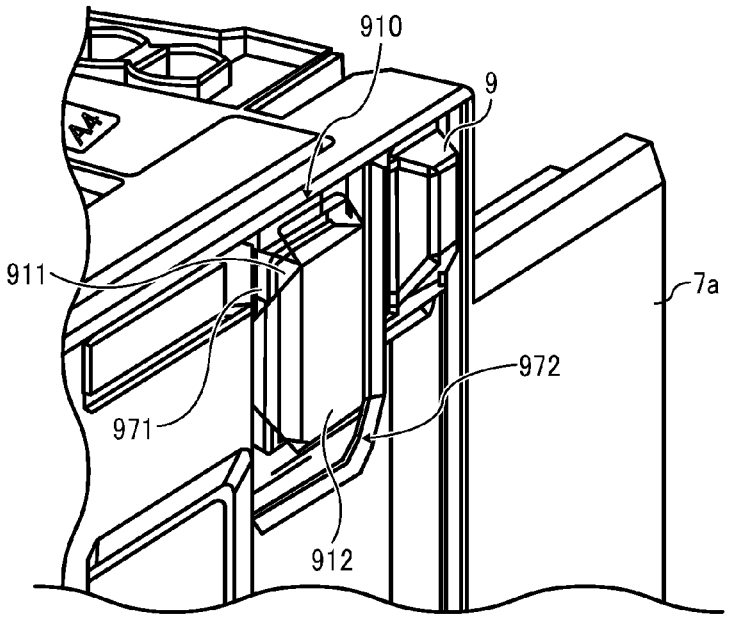
FIG. 24A is an enlarged perspective view illustrating the pressure assist member.
Figure 24B:
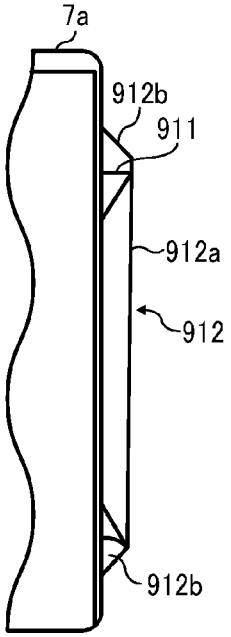
FIG. 24B is a side view illustrating the pressure assist member in the vertical direction.
Figure 24C:
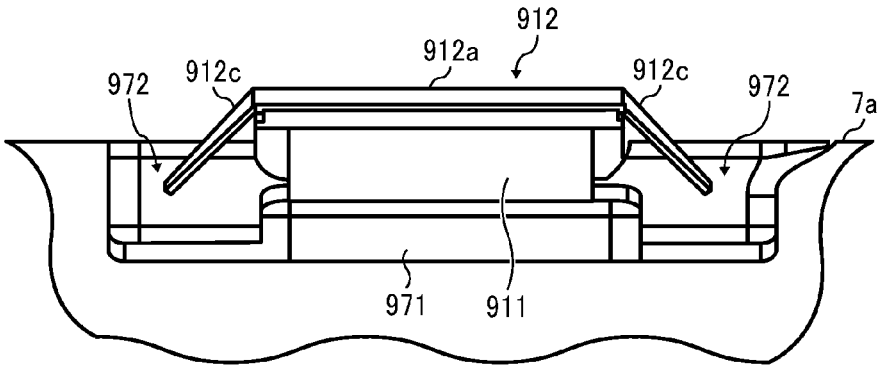
FIG. 24C is a cross sectional view illustrating a mylar end included in the pressure assist member and a groove mounted on the pressing side fence.

FIG. 23A is a perspective view illustrating the pressing side fence 7*a* and the pressure assist member 910 mounted on the pressing side fence 7*a*. FIG. 23B is a diagram illustrating the pressure assist member 910 and a vertical relation of the sheet bundle P2 loaded on the bottom plate 3 and the pressure assist member 910. FIG. 24A is an enlarged perspective view illustrating the pressure assist member 910. FIG. 24B is a side view illustrating the pressure assist member 910 in the vertical direction. FIG. 24C is a cross sectional view illustrating a mylar end 912*b* included in the pressure assist member 910 and a groove 972 mounted on the pressing side fence 7*a*.

As illustrated in FIG. 23A, the pressure assist member 910 to support the pressing force of the pressing member 9 to the sheets is disposed at a substantially same height as the pressing member 9. As illustrated in FIG. 23B, even if the number of sheets of the sheet bundle P2 loaded on the bottom plate 3 with the sheet pickup roller 4 in contact with the uppermost sheet is smaller than the predetermined value or approaches zero sheet to be the sheet empty state, the pressure assist member 910 can press the sheet bundle P2 against the regulating side fence 7*b* at this height.

The pressure assist member 910 is located at this height because of the following reasons.

There are some cases that a sheet feeding force exerted by the sheet pickup roller 4 is applied to the uppermost sheet of the sheet bundle P2 fed by the sheet pickup roller 4 not in the correct sheet transfer direction but in an oblique direction because of uneven contact of the sheet pickup roller 4 to the uppermost sheet or because the sheet pickup roller 4 is obliquely disposed. When the sheet feeding force is applied as described above, the uppermost sheet is fed obliquely, and therefore a force is applied in a direction orthogonal to the sheet conveying direction to the subsequent sheets.

Therefore, if the pressing force applied by the pressing member 9 is canceled when the number of sheets loaded on the bottom plate 3 is smaller than the predetermined value or approaches zero sheet to be the sheet empty state, it is likely that the position in the sheet width direction of the sheet bundle is shifted as described below.

After the pressing force is released, a gap is generated between the sheets once pressed to a reference position and the pressing side fence 7*a*. When the force applied in the direction orthogonal to the sheet conveying direction, the sheet is shifted from the reference position and is conveyed in the shifted state. By so doing, the position of the sheet in the width direction is likely to occur.

In order to address this inconvenience, as described above, even if the number of sheets of the sheet bundle P2 is smaller than the predetermined value and approaches zero sheet to be a sheet empty state, the pressure assist member 910 disposed at a height where the sheet bundle P2 is pressed against the regulating side fence 7*b* presses the sheet to reduce occurrence of the positional shift in the sheet width direction.

As described above, the pair of side fences 7*a* and 7*b* are screwed at the regulating position to regulate the position of the sheet (see FIG. 6), and the pressing member 9 includes the pressing portion 91 that projects from the pressing side fence 7*a* (see FIG. 7). Then, the sheet feed tray 1 includes the pressure assist member 910 that supports the pressing force of the pressing member 9 to press the sheet against the regulating side fence 7*b*. The pressure assist member 910 is disposed at the substantially same height as the pressing portion 91 of the pressing member 9.

Accordingly, as described above, even in the configuration in which the force orthogonal to the sheet conveying direction is applied while the uppermost sheet is being conveyed, the sheet pressed to the reference position can be kept at the reference position when the number of sheets loaded on the sheet feed tray 1 is smaller than the predetermined value and approaches zero sheet to be the sheet empty state.

As an example of the pressure assist member 910, as illustrated in FIGS. 24A through 24C, a sponge 911 that includes an elastic body is attached to a sponge attachment table 971 that is mounted on the pressing side fence 7*a*, and a mylar 912 is attached to the sponge 911 on a side facing the sheet.

As illustrated in FIGS. 23B and 24B, the sponge 911 separates from the pressing side fence 7*a* as advances upwards. The pressure assist member 910 includes a sloped face 912*a* of the mylar 912 that contacts the sheet. Similar to the sloped face 9*b* that approaches to the pressing side fence 7*a* as advances to the lower part of the pressing member 9, the sloped face 912*a* is provided to prevent the sheet from being caught by the mylar 912. The shape of the sloped face 912*a* is not limited to be a flat face as illustrated in FIGS. 23B and 24B but may be a curved face.

Accordingly, the sheet can be prevented from being caught by the lower end of the pressure assist member 910 while the bottom plate 3 is elevating. At the same time, the uppermost sheet of the sheet bundle can be pressed reliably.

Further, the mylar 912 includes sloped faces extending in the vertical direction as illustrated in FIGS. 23B and 24B and sloped faces extending in the sheet conveying direction as illustrated in FIG. 24C. The sloped faces extending in the vertical direction are provided at both upper and lower sides of the sloped face 912*a*, whose rear side is attached to the sponge 911. The sloped faces extending in the sheet conveying direction are provided at both upstream and downstream sides in the sheet conveying direction.

The sloped face of the lower side can enhance an effect to prevent the sheet from being caught at the lower end of the pressure assist member 910 while the bottom plate 3 is elevating. Further, the shape of the sloped faces extending in the vertical direction and the sloped faces extending in the sheet conveying direction are not limited to be a flat face as illustrated in FIGS. 23B and 24B but may be a curved face.

Further, one of the sloped faces in the sheet conveying direction corresponds to an upstream side sloped face 912*c* of the mylar 912 extending in the sheet conveying direction. The upstream side sloped face 912*c* approaches to the pressing side fence 7*a* as advances to the sheet supply tray 2 that functions as a second sheet container. In other words, a distance between the upstream side sloped face 912*c* and the pressing side fence 7*a* decreases toward the upstream side in the sheet conveying direction. Similar to the sloped face 9*g* that approaches to the pressing side fence 7*a* as advances to the sheet supply tray 2, the upstream side sloped face 912*c* is provided to prevent the sheet from being caught by the mylar 912. The shape of the upstream side sloped face 912*c* is not limited to be a flat face as illustrated in FIG. 24C but may be a curved face.

Accordingly, even if the sheet bundle while being conveyed to the sheet supply tray 2 contacts the pressure assist member 910, the sheet can be moved to the regulating side fence 7*b* smoothly due to the upstream side sloped face 912*c* close to the sheet supply tray 2. Accordingly, the sheet being transferred to the sheet feed tray 1 can be transferred smoothly without being caught by the pressure assist member 910.

Further, the pressing force (the biasing force) of the pressure assist member 910 to the sheet is set smaller than the pressing force of the pressing member 9 to the sheet.

The configuration is made because, when the pressing force applied by the pressure assist member 910 to the sheet is equal to or greater than a pressing force applied by the pressing member 9 to the sheet, the sheet is conveyed under the condition that the sheet is bent, and it is likely that the positional shift can occur.

The pressing force of the pressure assist member 910 to the sheet is substantially equal to a pressing force to prevent the positional shift when the number of sheets is smaller than the predetermined value and approaches zero sheet to be the sheet empty state. In other words, a force to press and move the sheet such as the pressing member 9 is not needed.

Further, as described above, the pressing force of the pressure assist member 910 to the sheet is set smaller than the pressing force of the pressing member 9 to the sheet. Therefore, the positional shift due to the load to the sheet is not caused, and the sheet can be fed at the reference position until the out of paper.

Further, as illustrated in FIG. 24C, a groove 972 is provided to the mylar 912, around the sponge attachment table 971. By providing the groove 972, the mylar 912 does not include a reverse step with respect to the sheet. In addition, the groove 972 prevents the sloped faces in the vertical direction and the sloped faces in the sheet conveying direction, which are the end portions of the mylar 912, from contacting the bottom after the sponge 911 is crushed and flattened.

Further, the pressure assist member 910 described above is located parallel to the pressing member 9. However, the configuration is applicable to this disclosure as long as the pressure assist member 910 is located at the same position as the pressing member 9. For example, a pressure assist member may be added on a sheet pressing face of a pressing member.

Further, the pressure assist member 910 described above includes the sponge 911 (an elastic body) and the mylar 912. However, the configuration is applicable to this disclosure as long as the pressure assist member includes a plate and a spring, or a single elastic body.

As described above, except when the small amount of sheets are loaded on the bottom plate 3 (after the pressure is canceled), the sheet is pressed to the reference position by the pressing member 9. When the small amount of sheets are loaded on the bottom plate 3, the pressure assist member 910 presses the sheet. By so doing, the end position of the sheets when using a tandem sheet tray can be aligned.

This configurations according to the above-descried embodiments are not limited thereto. This disclosure can achieve the following aspects effectively.

Aspect 1.

In Aspect 1, a sheet containing device (for example, the tandem sheet tray 114*a*) includes a first sheet container (for example, the sheet feed tray 1), a second sheet container (for example, the sheet supply tray 2) disposed adjacent to the first sheet container, a transfer unit (for example, the sheet transfer fence 8) to transfer a bundle of sheets contained in the second sheet container to the first sheet container, a pair of side fences (for example, the pair of side fences 7*a* and 7*b*) including a first side fence (for example, the pressing side fence 7*a*) and a second side fence (for example, the regulating side fence 7*b*) to regulate a position of the bundle of sheets in a width direction of the bundle of sheets loaded on the first sheet container), and a pressing unit (for example, the pressing member 9 and pressure spring 75) pressing the bundle of sheets that are loaded on the first sheet container against the second side fence.

According to this configuration, since the pressing unit is provided on the first side fence, even if there is a gap between a sheet and the pair of side fences, the pressing unit presses the sheet against the second side fence, so that the position of the sheet in the width direction can be regulated. As a result, the position of conveyance of the sheet is prevented from varying in the width direction.

Aspect 2.

In Aspect 1, the pressing unit (for example, the pressing member 9 and pressure spring 75) presses an upper sheet of the bundle of sheets loaded on the first sheet container against the second side fence (for example, the regulating side fence 7*b*).

According to this configuration, as described in the above-described embodiments, when the sheet projected toward the first side fence (for example, the pressing side fence 7*a*) is pressed by the pressing unit, a pressing force applied by the pressing unit can press the sheet toward the second side fence easily, and therefore the projecting portion of the sheet cannot be bent.

Aspect 3.

In Aspect 1 or Aspect 2, the sheet containing device (for example, the tandem sheet tray 114*a*) further includes a bottom plate (for example, the bottom plate 3) disposed in the first sheet container to load the bundle of sheets, a sheet conveying unit (for example, the sheet pickup roller 4) to feed a sheet from the bundle of sheets loaded on the bottom plate in the first sheet container, and a lifting unit (for example, the lift drive 20) to elevate the bottom plate such that at least a downstream end in a sheet conveying direction of an uppermost sheet of the bundle of sheets is located at a sheet feeding position. The pair of side fences (for example, the pressing side fence 7*a* and the regulating side fence 7*b*) is fixed (for example, screwed by the screw 73, as illustrated in FIG. 6) to a regulating position at which the position of the bundle of sheets is regulated. The pressing unit (for example, the pressing member 9 and the pressure spring 75) includes a projecting portion (for example, the pressing portion 91) projecting from the first side fence (for example, the pressing side fence 7*a*). The projecting portion is located above the uppermost sheet of the bundle of sheets to be transferred to the first sheet container (for example, the sheet feed tray 1) and below the sheet feeding position.

According to this configuration, as described in the above-described embodiments, the sheet can be prevented from being caught by the projecting portion while the sheet is being transferred to the first sheet container, and therefore occurrence of the transfer failure of the bundle of sheets can be restrained. Further, as the sheet such as the bundle of sheets loaded on the bottom plate is lifted by the lifting unit, the sheet loaded on the bottom plate contacts the projecting portion. Then, the sheet contacts the second side fence (for example, the regulating side fence 7*b*) via the projecting portion. As a result, the pressing unit can regulate the position in the width direction of the sheet, and therefore it is prevented that the sheet transfer position from varying in the width direction of the sheet.

Aspect 4.

In Aspect 3, the projecting portion (for example, the pressing portion 91) includes a sloped face (for example, the sloped face 9*b* having a flat face or a curved face). A distance between the sloped face and the first side fence (for example, the pressing side fence 7*a*) increases upwardly.

According to this configuration, as described in the above-described embodiments, the sheet loaded on the bottom plate (for example, the bottom plate 3) can be transferred to the second side fence (for example, the regulating side fence 7*b*) smoothly with the aid of the sloped face.

Aspect 5.

In Aspect 3 or Aspect 4, the pressing unit (for example, the pressing member 9 and the pressure spring 75) is held by the first side fence (for example, the pressing side fence 7*a*) to be movable in the width direction of the sheet. The pressing unit includes a projection (for example, the pressing member 9) having the projecting portion, and a biasing unit (for example, the pressure spring 75) to bias the projection toward the sheet. The first side fence includes a guide (for example, the guide groove 71*b*) to regulate a vertical position of the projection and guide the projection in the width direction of the sheet.

According to this configuration, as described in the above-described embodiments, even if the sheet that is elevated with the bottom plate (for example, the bottom plate 3) contacts the projecting portion (for example, the pressing portion 91) of the projection and eventually a pressing force is applied to the projection in a direction in which the projecting portion is lifted, the guide can prevent rotation of the projection, and therefore the posture of the projecting portion can be maintained. Accordingly, when the projection is pressed against the first side fence due to the rigidity of multiple sheets in contact with the second side fence (for example, the regulating side fence 7*b*), the projection moves toward the first side fence while being guided by the guide. As a result, the sheet that has contacted the second side fence can be prevented from being bent, and therefore occurrence of the sheet feed failure and the significant shift of the sheet conveying position to the width direction can be prevented.

Aspect 6.

In Aspect 3 or Aspect 4, the pressing unit (for example, the pressing member 901 and the pressure spring 75) includes a projection (for example, the pressing member 901) having the projecting portion, and a biasing unit (for example, the pressure spring 75) to bias the projection toward the sheet. The projection is rotatably supported by the first side fence (for example, the pressing side fence 7*a*) at a position below the projecting portion.

According to this configuration, as described in Variation 1, when the projection is pressed toward the first side fence, the projection can rotate to move the projecting portion toward the first side fence. Accordingly, the projecting portion of the projection can move toward the first side fence smoothly even without the guide (for example, the guide groove 71*b*) attached to the first side fence, and therefore the configuration of the sheet containing device can be simplified. Further, this configuration can reduce a sliding resistance of the projection with respect to the first side fence when the projecting portion of the projection moves in the width direction of the sheet when compared with a configuration in which the projection is movably held in the width direction of the sheet with respect to the first side fence. As a result, the projecting portion of the projection can be moved toward the pressing side fence smoothly.

Aspect 7.

In Aspect 3 or Aspect 4, the pressing unit (for example, the pressing unit (for example, the pressing member 9 and the pressure spring 75) includes a thin plate member held by the first side fence (for example, the pressing side fence 7*a*) and extending longer in a moving direction of the bottom plate. The thin plate member includes a sloped portion (for example, the leaf spring 902*b*) inclining with respect to the vertical direction. An upper part of the sloped portion is a projecting portion projecting from the first side fence.

According to this configuration, as described in Variation 2, as the bottom plate is elevated in a state in which the sheet loaded on the bottom plate (for example, the bottom plate 3) is in contact with the upper portion of the thin plate member, the thin plate member is bent toward the first side fence. Accordingly, a resilience is generated in the thin plate member, and therefore the sheet can be pressed against the second side fence (for example, the regulating side fence 7*b*). As a result, the sheet can be pressed toward the second side fence without using any biasing member (for example, the pressure spring 75). By so doing, the number of parts can be reduced, and therefore the sheet containing device (for example, the tandem sheet tray 114*a*) can achieve a reduction in cost.

Aspect 8.

In Aspect 7, the projecting portion of the thin plate member has a low friction member (for example, the low friction member 903) having a friction coefficient with the sheet smaller than a friction coefficient with the thin plate member.

According to this configuration, as described in the above-described embodiment with reference to FIG. 21, the sheet can be moved to the second side fence (for example, the regulating side fence 7*b*) smoothly without being caught by the thin plate member.

Aspect 9.

In Aspect 7 or Aspect 8, the sheet containing device (for example, the tandem sheet tray 114*a*) further includes a cover (for example, the low friction member 903) to cover the projecting portion of the thin plate member.

According to this configuration, as described in the above-described embodiment with reference to FIG. 21, the cover covers the projecting portion of the thin plate member that projects from the first side fence (for example, the pressing side fence 7*a*), and therefore the safety of the sheet containing device (for example, the tandem sheet tray 114*a*).

Aspect 10.

In Aspect 1 or Aspect 2, the pair of side fences (for example, pressing side fence 7*a* and the regulating side fence 7*b*) is secured (for example, screwed by the screw 73, as illustrated in FIG. 6) to a regulating position at which a position of the sheet is regulated. The pressing unit (for example, the pressing member 9 and the pressure spring 75) includes a projecting portion (for example, pressing portion 91) projecting from the first side fence (for example, the pressing side fence 7*a*). The projecting portion includes a sloped face (for example, the sloped face 9*g* having a flat face or a curved face). A distance between the sloped face and the first side fence decreases toward an upstream side in the sheet conveying direction.

According to this configuration, as described in the above-described embodiment with reference to FIGS. 22A and 22B, even if the sheet contacts the projecting portion while being conveyed and transferred to the first sheet container (for example, the sheet feed tray 1), the sheet can be moved to the second side fence smoothly with the aid of the sloped face. Therefore, the sheet that is being conveyed can be transferred to the first sheet container without being caught by the projecting portion.

Aspect 11.

In any one of Aspect 1 through Aspect 10, the sheet containing device (for example, the tandem sheet tray 114*a*) further includes a pressure releasing device (for example, the pressure releasing mechanism 60) to release a pressure of the pressing unit (for example, the pressing member 9 and the pressure spring 75) to the sheet to press against the second side fence (for example, the regulating side fence 7*b*) when a number of sheets in the first sheet container (for example, the sheet feed tray 1) is smaller than a predetermined value.

According to this configuration, as described in the above-described embodiments, the sheet can be prevented from being bent by the pressing force applied by the pressing unit when the number of sheets in the first sheet container is smaller than the predetermined value. Therefore, a failure in which the occurrence of the sheet feed failure and the significant shift of the sheet conveying position to the width direction can be prevented.

Aspect 12.

In Aspect 11, the sheet containing device (for example, the tandem sheet tray 114*a*) further includes a bottom plate (for example, the bottom plate 3) disposed in the first sheet container (for example, the sheet feed tray 1) to load the sheet, a sheet feeding unit (for example, the sheet pickup roller 4) to feed a sheet from the bundle of sheets loaded on the bottom plate of the first sheet container, and a lifting unit (for example, the lift drive 20) to elevate the bottom plate such that at least a downstream end in the sheet conveying direction of an uppermost sheet of the bundle of sheets is located at a sheet feeding position. The pressure releasing device is mounted on the bottom plate. After the pressing unit (for example, the pressing member 9 and the pressure spring 75) has pressed a lowermost sheet of the bundle of sheets loaded on the bottom plate against the second side fence (for example, the regulating side fence 7*b*), the pressure releasing device releases the pressing force applied by the pressing member.

According to this configuration, as described in the above-described embodiments, after the whole sheets loaded on the bottom plate (for example, the bottom plate 3) has been aligned to a predetermined position in the width direction of the sheet, the pressing force applied by the pressing unit to the sheet can be released. Accordingly, the whole sheets can be conveyed to the last sheet without variation of the sheet conveying position in the width direction of the sheet. Therefore, the image can be formed on the predetermined position.

Aspect 13.

In Aspect 12, the pressure releasing device (for example, the pressure releasing mechanism 60) adjusts the position of the bundle of sheets in the width direction of the sheet with respect to the bottom plate (for example, the bottom plate 3).

According to this configuration, as described in the above-described embodiments, the position of the pressure releasing device with respect to the bottom plate can be adjusted according to the position in the width direction of the sheet in the first side fence (for example, the pressing side fence 7*a*). Accordingly, even if the position in the width direction of the sheet in the first side fence is changed, after the pressing unit (for example, the pressing member 9 and the pressure spring 75) has pressed the lowermost sheet of the sheets loaded on the bottom plate toward the second side fence (for example, the regulating side fence 7*b*), the pressure releasing device can be pressed against the pressing unit.

Aspect 14.

In Aspect 12 or Aspect 13, the pressure releasing device (for example, the pressure releasing mechanism 60) includes a releasing member (for example, the releasing member 62) movably held in the width direction of the sheet and releasing a pressing force by containing the pressing unit, and a biasing unit (for example, the release spring 63) to bias the releasing member toward the pressing unit (for example, the pressing member 9 and the pressure spring 75).

According to this configuration, as described in the above-described embodiments, when the pressure releasing device contacts the first side fence (for example, the pressing side fence 7*a*) in a state in which the pressure releasing device is located closer to the first side fence than the predetermined position due to manufacturing errors and assembling errors, it is prevented that the pressure releasing device moves to the second side fence (for example, the regulating side fence 7*b*) to increase the contact pressure with the first side fence. Accordingly, this configuration can reduce and restrain a load on the bottom plate (for example, the bottom plate 3) during elevation of the bottom plate when the releasing member contacts the first side fence.

Aspect 15.

In Aspect 14, a biasing force applied by the biasing unit to biasing the releasing device (for example, the releasing member 62) against the pressing unit (for example, the pressing member 9 and the pressure spring 75) is greater than a pressing force applied by the pressing unit to press the sheet against the second side fence (for example, the regulating side fence 7*b*).

According to this configuration, as described in the above-described embodiments, after the releasing member has contacted the pressing unit, the pressing unit can be pressed by the releasing member toward the first side fence, and therefore can release the pressure of the pressing unit.

Aspect 16.

In any one of Aspect 11 through Aspect 15, the sheet containing device (for example, the tandem sheet tray 114*a*) further includes a pressure assist unit (for example, the pressure assist member 910) to assist the pressing force applied by the pressing unit (for example, the pressing member 9 and the pressure spring 75) to press the sheet against the second side fence (for example, the regulating side fence 7*b*). The first side fence (for example, the pressing side fence 7*a*) is secured (for example, screwed by the screw 73, as illustrated in FIG. 6) to a regulating position at which a position of the sheet is regulated. The pressing unit includes a projecting portion (for example, the pressing portion 91) projecting from the first side fence (for example, the pressing side fence 7*a*). The pressure assist unit is located at a position having a substantially same height as the projecting portion.

According to this configuration, as described in the above-described embodiments, even in the configuration in which a force in a direction orthogonal to the sheet conveying direction is applied to the sheet while the sheet is being conveyed, the pressing unit can press so that the sheet being pressed to the reference position does not separate from the reference position when the smaller number of sheets is loaded.

Aspect 17.

In Aspect 16, the pressure assist unit (for example, the pressure assist member 910) includes at least a sloped face (for example, a sloped face having a flat face or a curved face such as the sloped face 912*a* and the lower side of the sloped face 912*a*). A distance between the sloped face and the first side fence (for example, the pressing side fence 7*a*) increases upwardly.

Accordingly, as described in the above-described embodiments, the sheet can be prevented from being caught by the lower end of the pressure assist unit while the bottom plate (for example, the bottom plate 3) is being elevated. At the same time, the uppermost sheet of the bundle of sheets (for example, the sheet bundle P2) can be pressed reliably.

Aspect 18.

In Aspect 16 or Aspect 17, the pressure assist unit (for example, the pressure assist member 910) includes a sloped face (for example, a sloped face having a flat face or a curved face such as the sloped face 912*c* of the mylar 912 on a side close to the sheet supply tray 2). A distance between the sloped face and the first side fence (for example, the pressing side fence 7*a*) decreases toward an upstream side in the sheet conveying direction.

Accordingly, as described in the above-described embodiment with reference to FIG. 24C, even if the sheet contacts the pressure assist unit while being conveyed and transferred to the first sheet container (for example, the sheet feed tray 1), the sheet can be moved to the second side fence (for example, the regulating side fence 7*b*) smoothly with the aid of the sloped face. As a result, the sheet is not caught by the pressure assist unit while the sheet is being transferred smoothly.

Aspect 19.

A sheet feeder (for example, the sheet feeding device 114) includes the sheet containing device (for example, the tandem sheet tray 114*a*) according to Aspect 1 to contain a sheet, and a sheet feeding unit (for example, the sheet pickup roller 4) disposed near the sheet containing device to feed the sheet from the sheet containing device.

According to this configuration, as described in the above-described embodiments, the sheet can be conveyed with no or less positional shift in the width direction of the sheet.

Aspect 20.

An image forming apparatus (for example, the image forming apparatus 100) includes the sheet containing device (for example, the tandem sheet tray 114*a*) according to Aspect 1 to contain a sheet, and an image forming device (for example, the image forming units 101Y, 101C, 101M, and 101K) to form an image on the sheet fed from the sheet containing device.

According to this configuration, as described in the above-described embodiments, occurrence of the positional shift of the image to the sheet can be restrained.

Aspect 21.

An image forming apparatus (for example, the image forming apparatus 100) includes an image forming device (for example, the image forming units 101Y, 101C, 101M, and 101K) to form an image on a sheet, and the sheet feeder (for example, the sheet feeding device 114) to feed the sheet contained in the sheet conveying device (for example, the tandem sheet tray 114*a*) toward the image forming device.

According to this configuration, as described in the above-described embodiments, the sheet can be conveyed with no or less positional shift in the width direction of the sheet, and therefore occurrence of the positional shift of the image to the sheet can be restrained.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet containing device comprising:

a first sheet container;

a second sheet container adjacent to the first sheet container;

a transfer unit configured to transfer a bundle of sheets contained in the second sheet container to the first sheet container;

a pair of side fences including a first side fence and a second side fence configured to regulate a position of the bundle of sheets in a width direction of the bundle of sheets loaded on the first sheet container;

a bottom plate in the first sheet container and configured to load the bundle of sheets;

a sheet conveying unit configured to feed a sheet from the bundle of sheets loaded on the bottom plate in the first sheet container;

a lifting unit configured to elevate the bottom plate such that at least a downstream end in a sheet conveying direction of an upper most sheet of the bundle of sheets is located at a sheet feeding position; and a pressing unit on the first side fence, the pressing unit configured to press the bundle of sheets loaded on the first sheet container against the second side fence and including a projecting portion projecting from the first side fence;

wherein the projecting portion is above a sheet full position, the sheet full position being a position at which a maximum number of sheets are in the first sheet container; and wherein the bundle of sheets do not contact the projecting portion when the bundle of sheets are transferred from the second sheet container to the first sheet container.

2. The sheet containing device according to claim 1, wherein the pressing unit is configured to press an upper sheet of the bundle of sheets loaded on the first sheet container against the second side fence.

3. The sheet containing device according to claim 1, wherein the projecting portion includes a sloped face, and wherein a distance between the sloped face and the first side fence upwardly increases.

4. The sheet containing device according to claim 1, wherein the pressing unit is held by the first side fence and is movable in the width direction of the bundle of sheets, wherein the pressing unit includes:

a projection having the projecting portion; and a biasing unit configured to bias the projection toward the sheet, wherein the first side fence includes a guide to regulate a vertical position of the projection and guide the projection in the width direction of the bundle of sheets.

5. The sheet containing device according to claim 1, wherein the pressing unit includes:

a projection having the projecting portion; and a biasing unit configured to bias the projection toward the sheet, wherein the projection is rotatably supported by the first side fence at a position below the projecting portion.

6. The sheet containing device according to claim 1, wherein the pressing unit includes a thin plate member held by the first side fence and extending longer in a moving direction of the bottom plate, wherein the thin plate member includes a sloped portion inclining with respect to a vertical direction, and wherein an upper part of the sloped portion is a projecting portion projecting from the first side fence.

7. The sheet containing device according to claim 6, wherein the projecting portion of the thin plate member has a low friction member having a friction coefficient with the sheet smaller than a friction coefficient with the thin plate member.

8. The sheet containing device according to claim 6, further comprising a cover covering the projecting portion of the thin plate member.

9. The sheet containing device according to claim 1, wherein the pair of side fences is secured to a regulating position at which a position of the sheet is regulated, wherein the pressing unit includes a projecting portion projecting from the first side fence, wherein the projecting portion includes a sloped face, wherein a distance between the sloped face and the first side fence decreases toward an upstream side in the sheet conveying direction.

10. The sheet containing device according to claim 1, further comprising a pressure releasing device configured to release a pressure of the pressing unit to the sheet to press against the second side fence when a number of sheets in the first sheet container is smaller than a predetermined value.

11. The sheet containing device according to claim 10, further comprising:

a bottom plate in the first sheet container to load the sheet;

a sheet feeding unit configured to feed a sheet from the bundle of sheets loaded on the bottom plate of the first sheet container; and a lifting unit configured to elevate the bottom plate such that at least a downstream end in the sheet conveying direction of an uppermost sheet of the bundle of sheets is located at a sheet feeding position, wherein the pressure releasing device is mounted on the bottom plate, and wherein, the pressure releasing device is configured to release pressing force applied by the pressing unit when a lowermost sheet of the bundle of sheets loaded on the bottom plate is pressed against the second side fence.

12. The sheet containing device according to claim 11, wherein the pressure releasing device is configured to adjust the position of the bundle of sheets in the width direction of the sheet with respect to the bottom plate.

13. The sheet containing device according to claim 11, wherein the pressure releasing device includes:

a releasing member movably held in the width direction of the sheet and configured to release the pressing force by contacting the pressing unit; and a biasing unit configured to bias the releasing member toward the pressing unit.

14. The sheet containing device according to claim 13, wherein a biasing force applied by the biasing unit to bias the releasing member against the pressing unit is greater than the pressing force applied by the pressing unit to press the sheet to the second side fence.

15. The sheet containing device according to claim 10, further comprising a pressure assist unit configured to assist a pressing force applied by the pressing unit to press the sheet against the second side fence, wherein the first side fence is secured to a regulating position at which a position of the sheet is regulated, wherein the pressing unit includes a projecting portion projecting from the first side fence, and wherein the pressure assist unit is located at a position having a substantially same height as the projecting portion.

16. The sheet containing device according to claim 15, wherein the pressure assist unit includes at least a sloped face, wherein a distance between the sloped face and the first side fence increases upwardly.

17. The sheet containing device according to claim 15, wherein the pressure assist unit includes a sloped face, and wherein a distance between the sloped face and the first side fence decreases toward an upstream side in the sheet conveying direction.

18. A sheet feeder comprising:

the sheet containing device according to claim 1; and a sheet feeding unit near the sheet containing device and configured to feed the sheet from the sheet containing device.

19. An image forming apparatus comprising:

the sheet containing device according to claim 1;

a sheet feeding unit near the sheet containing device and configured to feed the sheet from the sheet containing device; and an image forming device configured to form an image on the sheet fed by the sheet feeding unit.

20. The sheet containing device of claim 1, wherein the pair of side fences is fixed to a regulating position at which the position of the bundle of sheets is regulated.

21. The sheet containing device of claim 1, wherein the projection portion is below the sheet feeding position.

22. The sheet containing device according to claim 1, wherein when the bundle of sheets are in the first sheet container, the bundle of sheets are configured to be lifted upward from the first sheet container to be in contact with the projecting portion.

23. A sheet containing device comprising:

a first sheet container and a second sheet container adjacent to the first sheet container;

a transfer unit configured to transfer a plurality of sheets from the second sheet container to the first sheet container;

a first side wall and an opposite second side wall in a width direction of the plurality of sheets; and a pressing unit on the first side wall and including a projecting portion projecting from the first side wall;

wherein the projecting portion is above a sheet full position, the sheet full position being a position at which a maximum number of sheets are in the first sheet container; and wherein the plurality of sheets do not contact the projecting portion when the plurality of sheets are transferred from the second sheet container to the first sheet container.

24. The sheet containing device according to claim 23, wherein when the plurality of sheets are in the first sheet container, the plurality of sheets are configured to be lifted upward from the first sheet container to be in contact with the projecting portion.

* * * * *